US011263944B2

(12) United States Patent
Morita

(10) Patent No.: US 11,263,944 B2
(45) Date of Patent: Mar. 1, 2022

(54) CIRCUIT DEVICE, ELECTRO-OPTICAL DEVICE, AND ELECTRONIC APPARATUS

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/023,628

(22) Filed: Sep. 17, 2020

(65) Prior Publication Data

US 2021/0082332 A1 Mar. 18, 2021

(30) Foreign Application Priority Data

Sep. 18, 2019 (JP) ..... JP2019-168935

(51) Int. Cl.
*G09G 3/20* (2006.01)

(52) U.S. Cl.
CPC ..... *G09G 3/20* (2013.01); *G09G 2310/027* (2013.01); *G09G 2310/0291* (2013.01); *G09G 2310/08* (2013.01)

(58) Field of Classification Search
CPC ..... G09G 3/20; G09G 2310/08; G09G 2310/027; G09G 2310/0291; G09G 2320/0219
See application file for complete search history.

(56) References Cited

U.S. PATENT DOCUMENTS 6,160,437 A * 12/2000 Kim ..... H03K 17/08142 327/408
6,605,977 B2 * 8/2003 Martini ..... H03K 17/162 326/113
6,636,083 B1 * 10/2003 Wong ..... G11C 27/026 327/307
6,911,860 B1 * 6/2005 Wang ..... H03K 3/356113 327/333
7,728,649 B1 * 6/2010 Webb ..... H03K 17/165 327/534
7,924,085 B2 * 4/2011 Guo ..... H03K 17/6874 327/534
7,940,110 B2 * 5/2011 von Kaenel ..... H03K 17/6871 327/379

(Continued)

FOREIGN PATENT DOCUMENTS

JP S60-174518 A 9/1985
JP S60-254903 A 12/1985

(Continued)

*Primary Examiner* — Grant Sitta
(74) *Attorney, Agent, or Firm* — Oliff PLC

(57) ABSTRACT

A circuit device includes a transfer gate and a control circuit. The transfer gate includes a P-type transistor and an N-type transistor. The control circuit sets, as a first value, a transistor size ratio that is a ratio of a size of the P-type transistor to a size of the N-type transistor when a voltage of an input signal to the transfer gate is in a first voltage range at a timing at which the transfer gate is turned off. The control circuit sets the transistor size ratio as a second value greater than the first value when a voltage of the input signal is in a second voltage range lower than that in the first voltage range at a timing at which the transfer gate is turned off.

14 Claims, 16 Drawing Sheets

(56) References Cited

U.S. PATENT DOCUMENTS

| | | | | |
|---|---|---|---|---|
| 8,212,604 | B2 * | 7/2012 | Dianbo | H03K 17/063 327/389 |
| 8,860,497 | B1 * | 10/2014 | Pattnayak | H03K 17/0822 327/534 |
| 9,013,228 | B2 * | 4/2015 | Hasbani | H03K 19/0016 327/535 |
| 9,094,008 | B2 * | 7/2015 | Lee | H03K 17/6872 |
| 9,893,723 | B1 * | 2/2018 | Garofalo | G11C 7/08 |
| 10,164,624 | B2 * | 12/2018 | Garofalo | G11C 7/08 |
| 10,389,350 | B2 * | 8/2019 | Wang | H03K 17/164 |
| 2003/0011410 | A1 * | 1/2003 | Koizumi | H03K 5/151 327/124 |
| 2008/0204439 | A1 * | 8/2008 | Morita | G09G 3/3688 345/209 |
| 2010/0079428 | A1 * | 4/2010 | Kajino | G09G 3/344 345/208 |
| 2016/0133218 | A1 | 5/2016 | Morita | |
| 2016/0133219 | A1 * | 5/2016 | Morita | G09G 3/3696 345/213 |
| 2018/0026622 | A1 * | 1/2018 | Garofalo | G11C 7/1063 327/436 |
| 2018/0226047 | A1 | 8/2018 | Morita | |
| 2019/0088229 | A1 * | 3/2019 | Morita | G09G 3/3696 |
| 2019/0156906 | A1 * | 5/2019 | Nomura | H03F 3/45179 |
| 2020/0106975 | A1 * | 4/2020 | Oike | H04N 5/374 |
| 2020/0303002 | A1 * | 9/2020 | Miyazaki | G11C 13/0004 |

FOREIGN PATENT DOCUMENTS

| | | | |
|---|---|---|---|
| JP | S61-214815 | A | 9/1986 |
| JP | H8-335864 | A | 12/1996 |
| JP | 2006-148320 | A | 6/2006 |
| JP | 2016-90881 | A | 5/2016 |

* cited by examiner

| TGN, TGP | 4 | 3 | 2 | 1 |
|---|---|---|---|---|
| Ex.1 W/L | 36.0/3.2um | 20.0/3.2um | 10.0/3.2um | 6.0/3.2um |
| Ex.2 W/L | 24.0/3.2um | 20.0/3.2um | 16.0/3.2um | 12.0/3.2um |
| Ex.3 W/L | 18.0/3.2um | 18.0/3.2um | 18.0/3.2um | 18.0/3.2um |

FIG. 8

1st Voltage Range(10～12.5V)

| | | | |
|---|---|---|---|
| TGP4 | 0 | TGN4 | 1 |
| TGP3 | 1 | TGN3 | 1 |
| TGP2 | 0 | TGN2 | 1 |
| TGP1 | 1 | TGN1 | 1 |

3rd Voltage Range(7.5～10V)

| | | | |
|---|---|---|---|
| TGP4 | 1 | TGN4 | 1 |
| TGP3 | 0 | TGN3 | 1 |
| TGP2 | 0 | TGN2 | 1 |
| TGP1 | 1 | TGN1 | 1 |

4th Voltage Range(5～7.5V)

| | | | |
|---|---|---|---|
| TGP4 | 1 | TGN4 | 1 |
| TGP3 | 1 | TGN3 | 1 |
| TGP2 | 1 | TGN2 | 1 |
| TGP1 | 0 | TGN1 | 1 |

2nd Voltage Range(2.5～5V)

| | | | |
|---|---|---|---|
| TGP4 | 1 | TGN4 | 1 |
| TGP3 | 1 | TGN4 | 0 |
| TGP2 | 1 | TGN4 | 1 |
| TGP1 | 1 | TGN4 | 1 |

FIG. 9

CIRCUIT DEVICE, ELECTRO-OPTICAL DEVICE, AND ELECTRONIC APPARATUS

The present application is based on, and claims priority from JP Application Serial Number 2019-168935, filed Sep. 18, 2019, the disclosure of which is hereby incorporated by reference herein in its entirety.

BACKGROUND

1. Technical Field

The present disclosure relates to a circuit device, an electro-optical device, and an electronic apparatus.

2. Related Art

In switches using transistors, it has been known that feedthrough noise is generated when the switch is turned off. When a gate voltage of the transistor changes, charge discharge or charge injection occurs with respect to a source or a drain of the transistor via a parasitic capacitor of the transistor, resulting in generation of feedthrough noise. The feedthrough noise may be generated in various circuits including switches using transistors, and affects signal accuracy in the circuit.

JP-A-2016-90881 discloses a display driver including a switch using a transistor. The display driver in JP-A-2016-90881 includes a D/A converter circuit, an amplifier circuit, a switch, a capacitor driving circuit, and a capacitor circuit. The D/A converter circuit performs D/A conversion on gradation data, and outputs a D/A conversion voltage to an input node of the amplifier circuit, and the amplifier circuit drives an electro-optical panel, based on the D/A conversion voltage. Prior to the driving, the switch provided between the input node of the amplifier circuit and the capacitor circuit is turned on for a predetermined period of time. Then, the capacitor driving circuit outputs a voltage based on the gradation data to the capacitor circuit, and thus charge redistribution occurs between the capacitor circuit and a parasitic capacitor of the input node of the amplifier circuit. The charge redistribution causes the input node of the amplifier circuit to be assist-driven to the vicinity of the D/A conversion voltage, and then the D/A converter circuit outputs the D/A conversion voltage, and thus the input node of the amplifier circuit reaches the D/A conversion voltage at high speed.

A transfer gate in which a P-type transistor and an N-type transistor are coupled in parallel has been known as a switch using a transistor. When the switch is turned off, a gate voltage of the P-type transistor is set to a high level from a low level, and a gate voltage of the N-type transistor is set to the low level from the high level. Thus, it is conceivable that feedthrough noises cancel each other out by setting an equal transistor size for both of the transistors, namely, an equal parasitic capacitor for both of the transistors.

However, a parasitic capacitor between the source and a substrate and between the drain and the substrate fluctuates according to a source voltage and a drain voltage of the transistor, and a characteristic of the fluctuation is reversed between the P-type transistor and the N-type transistor. Thus, when the input voltage to the switch is high, a parasitic capacitor of the P-type transistor is greater, and when the input voltage to the switch is low, a parasitic capacitor of the N-type transistor is greater. Thus, feedthrough noises of the P-type transistor and the N-type transistor do not cancel each other out, and there is a problem that charge injection occurs when the input voltage to the switch is high, and charge discharge occurs when the input voltage to the switch is low.

For example, in JP-A-2016-90881, the input voltage of the switch is approximately the same as the D/A conversion voltage output from the D/A converter circuit. Since the voltage output from the D/A converter circuit changes according to the gradation data, feedthrough noise of the switch also changes according to the change. Such feedthrough noise affects an output of the amplifier circuit and affects a writing voltage of a pixel as a result, and may thus affect display quality.

SUMMARY

One aspect of the present disclosure relates to a circuit device that includes a transfer gate including a P-type transistor and an N-type transistor coupled in parallel between an input node and an output node, and being configured to input an input signal to the input node, and output an output signal to the output node, and a control circuit configured to control the transfer gate, where the control circuit performs control to set, as a first value, a transistor size ratio that is a ratio of a size of the P-type transistor to a size of the N-type transistor when a voltage of the input signal is in a first voltage range at a timing at which the transfer gate is turned off, and set the transistor size ratio as a second value greater than the first value when a voltage of the input signal is in a second voltage range lower than that in the first voltage range at a timing at which the transfer gate is turned off.

BRIEF DESCRIPTION OF THE DRAWINGS

FIG. 8 is an example of a size of a P-type sub-transistor and an N-type sub-transistor.

FIG. 9 is a diagram illustrating a second operation example in the first configuration example of the switch circuit.

DESCRIPTION OF EXEMPLARY EMBODIMENTS

Exemplary embodiments of the present disclosure will be described in detail hereinafter. Note that the exemplary embodiments described hereinafter are not intended to unjustly limit the content as set forth in the claims, and all of the configurations described in the exemplary embodiments are not always essential configuration requirements.

1. Circuit Device

Figure 1:
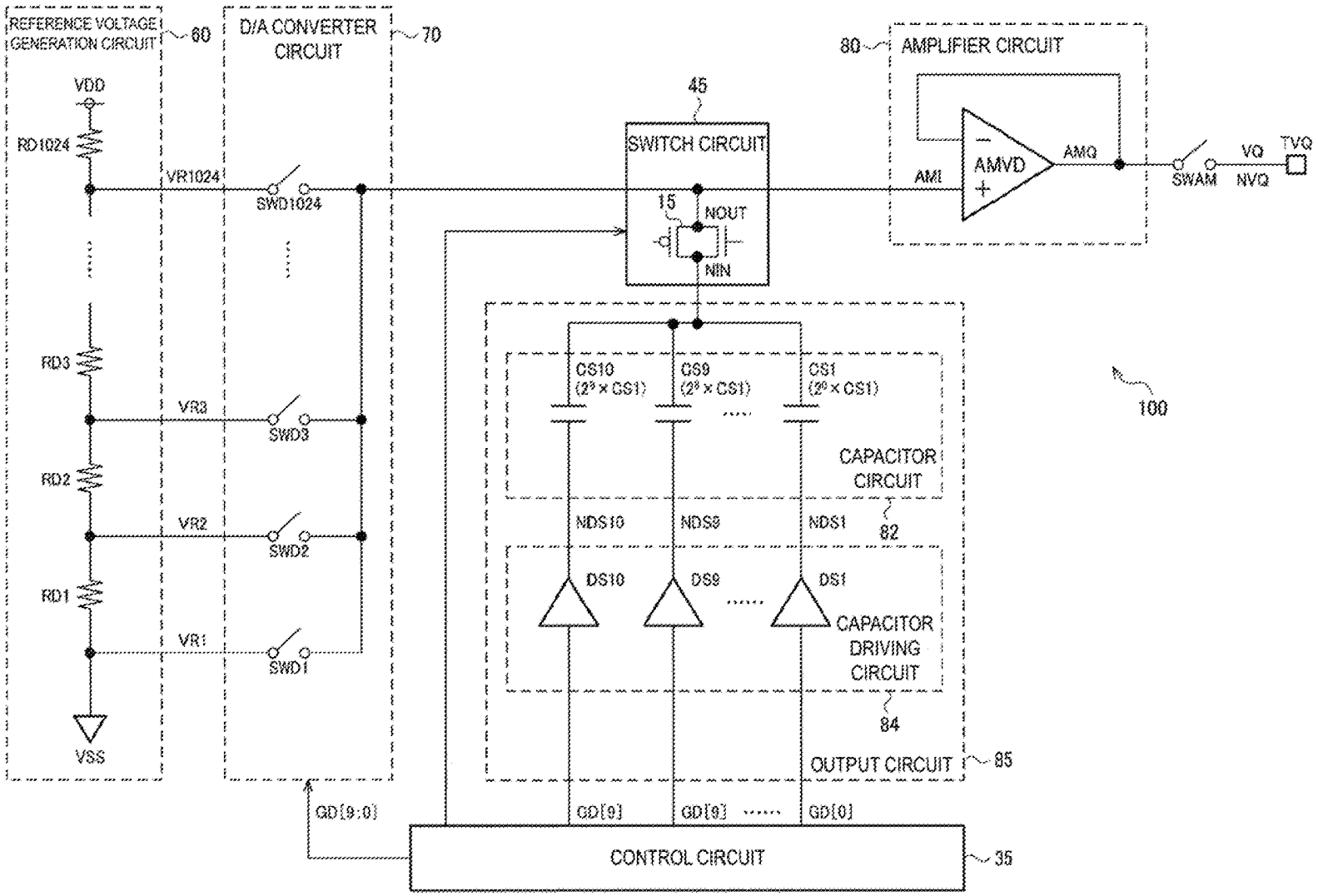
FIG. 1 is a first configuration example of a circuit device.

FIG. 1 is a first configuration example of a circuit device 100 including a switch circuit 45. The circuit device 100 includes a control circuit 35, the switch circuit 45, a reference voltage generation circuit 60, a D/A converter circuit 70, an amplifier circuit 80, an output circuit 85, and a switch SWAM. The switch circuit 45 includes the transfer gate 15. Note that an example in which the switch circuit 45 is used as a display driver will be described here, but an application target of the switch circuit 45 is not limited thereto. For example, the switch circuit 45 can be applied to a sample hold circuit described below.

The circuit device 100 is an integrated circuit device called an integrated circuit (IC). For example, the circuit device 100 is an IC manufactured by a semiconductor process, and is a semiconductor chip in which a circuit element is formed on a semiconductor substrate.

The control circuit 35 controls ON and OFF of the transfer gate 15. Further, as described later, the control circuit 35 performs feedthrough noise reduction control on the switch circuit 45. Further, the control circuit 35 outputs display data GD [9:0] to the D/A converter circuit 70 and the output circuit 85. The display data GD [9:0] are also referred to as input data. Here, it is assumed that the same data are input to the D/A converter circuit 70 and the output circuit 85, but data input to the D/A converter circuit 70 may be different from data input to the output circuit 85. In other words, data may be set such that a voltage output from the D/A converter circuit 70 and a voltage output from the output circuit 85 are approximately the same.

Based on the display data GD [9:0], the output circuit 85 outputs a data voltage corresponding to the display data GD [9:0] to an input node of the amplifier circuit 80. A signal output from the output circuit 85 is an input signal to an input node NIN of the transfer gate 15, and the input signal passes through the transfer gate 15 and is output as an output signal to an output node NOUT of the switch circuit 45. A voltage of the output signal corresponds to a data voltage output from the output circuit 85 to the input node of the amplifier circuit 80. The output circuit 85 includes a capacitor circuit 82 and a capacitor driving circuit 84.

The capacitor circuit 82 includes capacitors CS1 to CS10. The capacitor driving circuit 84 includes driving circuits DS1 to DS10. Hereinafter, i is an integer of 1 or more and 10 or less.

One end of the capacitor CSi is coupled to a capacitor driving node NDSi, and the other end of the capacitor CSi is coupled to the input node NIN of the switch circuit 45. The capacitors CS1 to CS10 each have a capacitance value weighted by a power of two. Specifically, a capacitance value of the capacitor CSi is $2^{(i-1)}\times$CS1. In this equation, CS1 indicates a capacitance value of the capacitor CS1.

A bit GD [i] of the display data GD [9:0] is input to the input node of the driving circuit DSi. The driving circuit DSi outputs a first voltage level when the bit GD [i] is at a first logic level and outputs a second voltage level when the bit GD [i] is at a second logic level. For example, the first logic level is a low level, the second logic level is a high level, the first voltage level is a voltage of a low potential side power supply VSS, and the second voltage level is a voltage of a high potential side power supply VDD. The driving circuit DSi includes a level shifter configured to level-shift the input logic level to an output voltage level of the driving circuit DSi and a buffer circuit configured to buffer the output of the level shifter.

The transfer gate 15 is a P-type transistor and an N-type transistor coupled in parallel between the input node NIN and the output node NOUT. When the transfer gate 15 is turned on, the input node NIN and the output node NOUT are coupled to each other.

The reference voltage generation circuit 60 is a circuit configured to generate a reference voltage corresponding to each value of display data. For example, the reference voltage generation circuit 60 generates reference voltages VR1 to VR1024 for 1024 gradations corresponding to 10 bits of the display data GD [9:0].

Specifically, the reference voltage generation circuit 60 includes resistors RD1 to RD1024 coupled in series between the high potential side power supply VDD and the low potential side power supply VSS. The reference voltages VR1 to VR1024 obtained by the voltage division are output from the taps of the resistors RD1 to RD1024, respectively. VR512 corresponds to a common voltage. When the amplifier circuit 80 is a non-inverting amplifier circuit, VR1 to VR512 are used in the negative polarity driving period, and VR512 to VR1024 are used in the positive polarity driving period.

The D/A converter circuit 70 selects a reference voltage corresponding to the display data GD [9:0] from among the reference voltages VR1 to VR1024, and outputs the selected reference voltage as a voltage AMI to the output node NOUT. The voltage AMI is an input voltage of the amplifier circuit 80.

Specifically, the D/A converter circuit 70 includes switches SWD1 to SWD1024, and one ends of the switches SWD1 to SWD1024 are supplied with the reference voltages VR1 to VR1024, respectively. The other ends of the switches SWD1 to SWD1024 are commonly coupled. Any one of the switches SWD1 to SWD1024 corresponding to the display data GD [9:0] is turned on, and the reference voltage supplied to the switch is output as the voltage AMI. For example, the D/A converter circuit 70 includes a decoder (not illustrated), and the decoder decodes the display data GD [9:0] and thus generates an on/off control signal for the switches SWD1 to SWD1024.

The amplifier circuit 80 amplifies the voltage AMI from the D/A converter circuit 70, and outputs the amplified voltage to a data voltage output terminal TVQ via the switch SWAM. The amplifier circuit 80 includes an operational amplifier AMVD.

The amplifier circuit 80 is a voltage follower circuit. In other words, an inverting input terminal and the output terminal of the operational amplifier AMVD are coupled to each other, and the output node NOUT of the transfer gate 15 is coupled to an non-inverting input terminal of the operational amplifier AMVD. The non-inverting input terminal of the operational amplifier AMVD is an input of the voltage follower circuit, and the voltage AMI from the D/A converter circuit 70 is input to the input of the voltage follower. Note that the amplifier circuit 80 may be an inverting amplifier circuit as described below in FIG. 19. In this case, the amplifier circuit 80 inverts the output voltage of the D/A converter circuit 70 with reference to the common voltage, but the configuration and the operation of the switch circuit 45 described below are the same as those in a case of the voltage follower circuit. Hereinafter, a case in which the amplifier circuit 80 is a voltage follower circuit will be described as an example.

The switch SWAM is configured to couple or decouple the output of the operational amplifier AMVD to or from a data voltage output node NVQ. The switch SWAM is constituted of a transistor. The on/off control signal for the switch SWAM is supplied from the control circuit 35.

Figure 2:
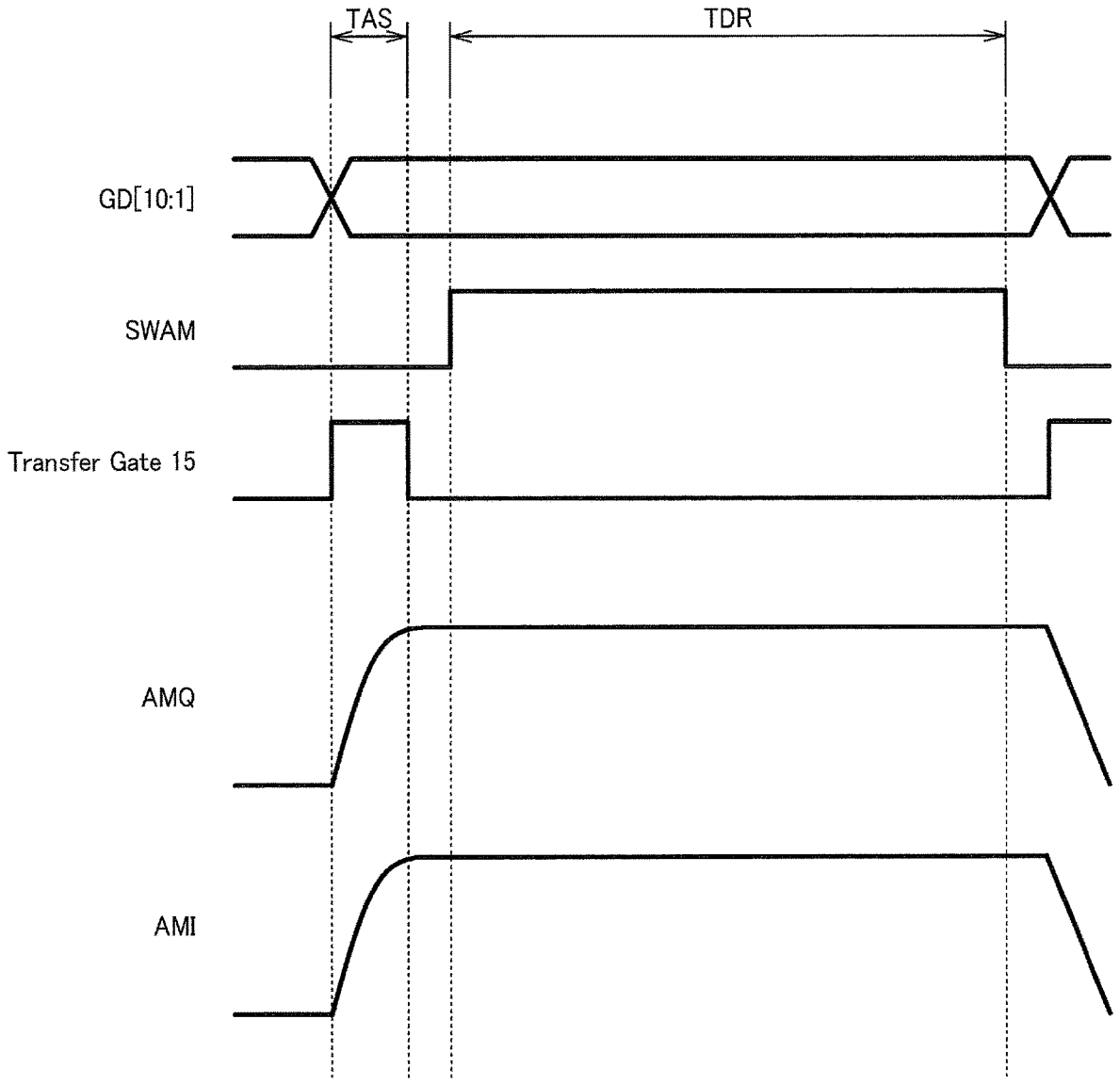
FIG. 2 is a waveform diagram illustrating an operation of the first configuration example of the circuit device.

FIG. 2 is a waveform diagram illustrating an operation of the first configuration example of the circuit device 100. FIG. 2 illustrates a waveform diagram when the amplifier circuit 80 writes one data voltage to one pixel.

During an assist period TAS, the transfer gate 15 is on, the switch SWAM is off, and the switches SWD1 to SWD1024 of the D/A converter circuit 70 are off. The input node of the amplifier circuit 80 has a parasitic capacitor, but the output circuit 85 charges the parasitic capacitor during the assist period TAS. In other words, the capacitor driving circuit 84 drives the capacitor circuit 82, and thus charge redistribution is performed between the capacitor circuit 82 and the parasitic capacitor via the transfer gate 15, and the charge redistribution causes the voltage AMI of the input node of the amplifier circuit 80 to approach the voltage corresponding to the display data GD [9:0]. At the end of the assist period TAS, the transfer gate 15 is turned off.

During a driving period TDR following the assist period TAS, the transfer gate 15 is off, the switch SWAM is on, and any of the switches SWD1 to SWD1024 of the D/A converter circuit 70 is turned on, based on the display data GD [9:0]. As a result, the D/A converter circuit 70 outputs a voltage corresponding to the display data GD [9:0] to the output node NOUT, and the amplifier circuit 80 buffers the voltage and outputs the voltage to the data voltage output node NVQ.

As described above, before the D/A converter circuit 70 outputs the D/A conversion voltage, the output circuit 85 performs assist driving, and thus a voltage of the input node of the amplifier circuit 80 is approximately the same as the D/A conversion voltage. As a result, the time required for the voltage AMI of the input node of the amplifier circuit 80 to a desired voltage is shortened since the D/A converter circuit 70 starts outputting the D/A conversion voltage, thereby enabling high-speed pixel driving.

A problem when the switch circuit 45 is a transfer gate having a fixed transistor size, that is, when a feedthrough noise reduction according to the present exemplary embodiment is not performed will be described.

In order to write an accurate data voltage to a pixel, the voltage AMI needs to be an accurate voltage at the end of the driving period TDR. At the start of the driving period TDR, the input node of the amplifier circuit 80 is approximately the voltage corresponding to the display data GD [9:0] by assist driving, but a voltage error occurs due to feedthrough noise and the like when the transfer gate is turned off. From the state with the error, the D/A converter circuit 70 converges the voltage in the driving period TDR, and thus the input node of the amplifier circuit 80 is asymptotic to the voltage corresponding to the display data GD [9:0].

However, high definition of a display panel or a high frame rate of a display tends to reduce a driving period of one pixel. Thus, when an error due to feedthrough noise and the like is great, the error cannot be sufficiently converged within the driving period TDR, and the display quality deteriorates. Further, when the number of bits of display data is increased in order to enhance the gray-scale representation of the display, a small voltage error causes display unevenness. For example, although the display data are 10 bits in FIG. 1, it is assumed that 12 bits of display data are used in order to enhance the gray-scale representation. In this case, when it is assumed that a voltage amplitude of driving is set to 10V, one gradation is 2.5 mV, and the display quality deteriorates only with a remaining voltage error of approximately several mV.

For the reason described above, there is a problem that great feedthrough noise when the transfer gate is turned off at the end of the assist period TAS leads to deterioration of the display quality. By using FIGS. 3 and 4, feedthrough noise generated by the transfer gate will be described.

Figure 3:
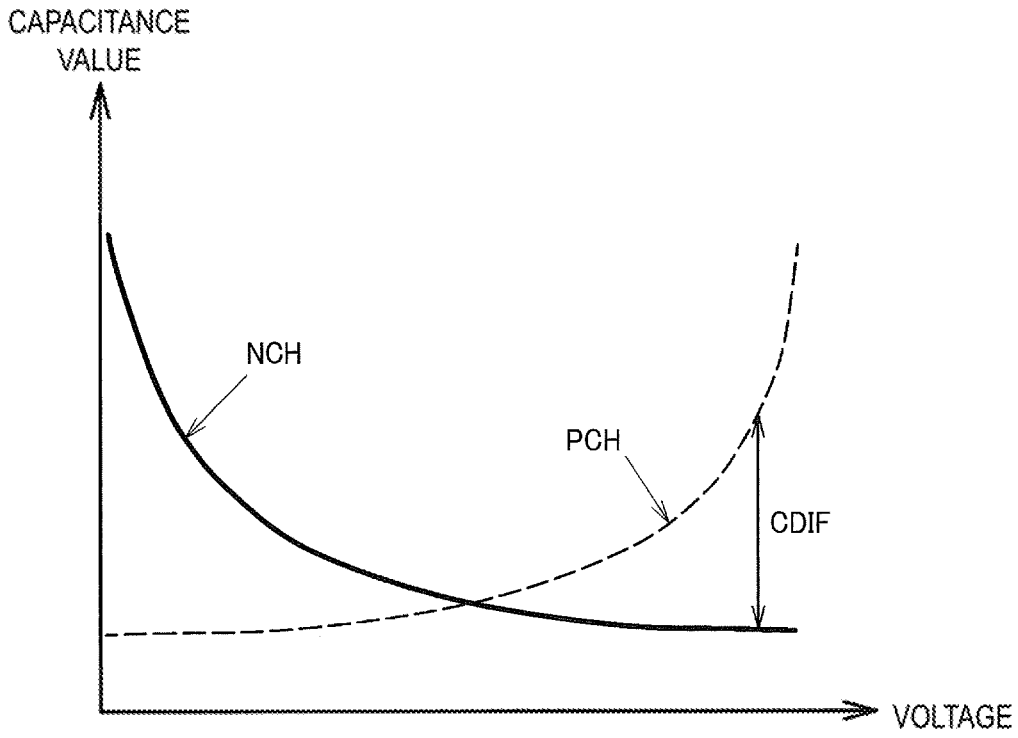
FIG. 3 is a voltage capacitance characteristic of a P-type transistor and a voltage capacitance characteristic of an N-type transistor.

FIG. 3 illustrates a voltage capacitance characteristic PCH of a P-type transistor and a voltage capacitance characteristic NCH of an N-type transistor. The horizontal axis is a source voltage or a drain voltage with reference to a substrate voltage, and the vertical axis is a capacitance value between a source and a substrate or between a drain and the substrate. In FIG. 3, the P-type transistor and the N-type transistor have the same size.

The substrate of the N-type transistor is a P type, and is set to, for example, a ground voltage. As the source voltage is farther away from the substrate voltage, that is, as the source voltage is higher, a depletion layer between the substrate and the source widens. Thus, in the voltage capacitance characteristic NCH of the N-type transistor, a capacitance value increases with a lower source voltage, and a capacitance value decreases with a higher source voltage. The same also applies to the drain.

The substrate of the P-type transistor is an N type, and is set to, for example, a power supply voltage. As the source voltage is farther away from the substrate voltage, that is, as the source voltage is lower, a depletion layer between the substrate and the source widens. Thus, in the voltage capacity characteristic PCH of the P-type transistor, a capacitance value decreases with a lower source voltage, and a capacitance value increases with a higher source voltage. The same also applies to the drain.

From the description above, even when the P-type transistor and the N-type transistor have the same size, a difference CDIF is generated between the parasitic capacitor of the P-type transistor and the parasitic capacitor of the N-type transistor. The difference CDIF varies according to the source voltage and the drain voltage. Thus, in the transfer gate that combines the P-type transistor and the N-type transistor, an influence of the feedthrough noise varies according to the voltage.

Specifically, when a voltage of the input signal to the transfer gate is close to the power supply voltage, the parasitic capacitor of the P-type transistor is greater, and thus an influence of the positive charge output from the P-type transistor when the transfer gate is off increases. This results in charge injection as seen from the output node of the transfer gate. The charge injection refers to injection of the positive charge into the node. On the other hand, when a voltage of the input signal to the transfer gate is close to the ground voltage, the parasitic capacitor of the N-type transistor is greater, and thus an influence of the negative charge output from the N-type transistor when the transfer gate is off increases. This results in charge discharge as seen from the output node of the transfer gate. The charge discharge refers to discharge of the positive charge from the node.

Figure 4:
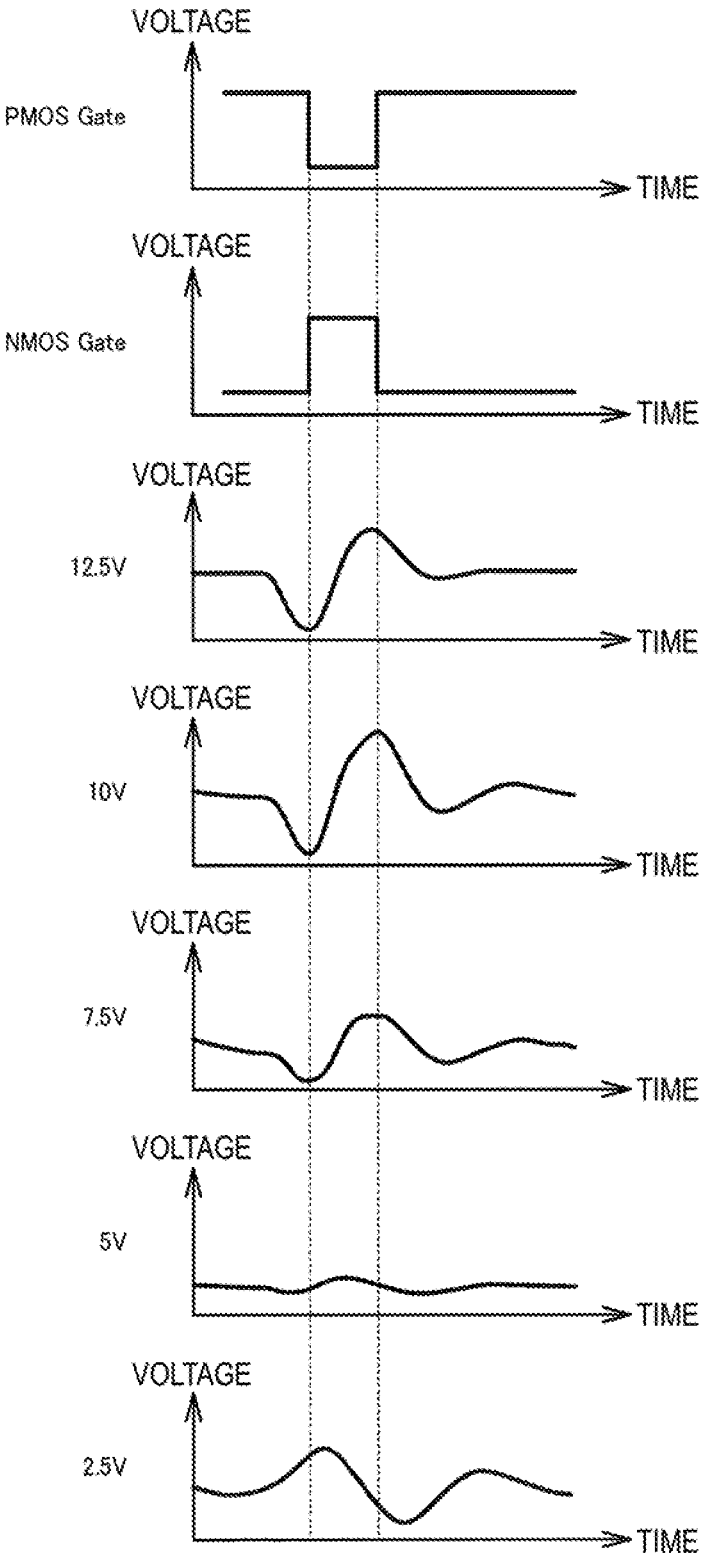
FIG. 4 is a simulation waveform of feedthrough noise generated from a transfer gate.

FIG. 4 is a simulation waveform of feedthrough noise generated from the transfer gate when feedthrough noise reduction processing according to the present exemplary embodiment is not performed. The P-type transistor and the N-type transistor have the same size. FIG. 4 illustrates a signal waveform of the output node when a voltage of the input signal to the transfer gate is 12.5V, 10V, 7.5V, 5V, and 2.5V. For example, in the display driver illustrated in FIG. 1, 7.5V is a common voltage, 7.5V to 12.5V is a voltage of positive polarity driving, and 7.5V to 2.5V is a voltage of negative polarity driving.

Hereinafter, feedthrough noise when the transfer gate is turned off from on will be focused. When the transfer gate is turned off from on, the gate voltage of the P-type transistor is set to a high level from a low level, and thus the P-type transistor injects the charge into the output node. On the other hand, since the gate voltage of the N-type transistor is set to the low level from the high level, the N-type transistor discharges the charge from the output node.

When a voltage of the input signal is 12.5V, 10V, and 7.5V, the parasitic capacitor of the P-type transistor is greater than the parasitic capacitor of the N-type transistor, and thus the amount of the charge injected into the output node by the P-type transistor is greater than the amount of the charge discharged from the output node by the N-type transistor. Thus, the charge injection is performed by the entire transfer gate. When a voltage of the input signal is 5V, the amount of the charge injected into the output node by the P-type transistor and the amount of the charge discharged from the output node by the N-type transistor are substantially equal, and thus feedthrough noise is small. When a voltage of the input signal is 2.5V, the parasitic capacitor of the N-type transistor is greater than the parasitic capacitor of the P-type transistor, and thus the amount of the charge discharged from the output node by the N-type transistor is greater than the amount of the charge injected into the output node by the P-type transistor. Thus, the charge discharge is performed by the entire transfer gate.

Note that, when an electro-optical panel having a relatively high driving voltage is driven in the display driver as in FIG. 1, a high pressure resistance process is used for the driving circuit. In the transistor of the high pressure resistance process, a depletion layer between the substrate, and the source and the drain is wide in order to increase pressure resistance. Thus, a fluctuation in parasitic capacitor with respect to a voltage change in the source and the drain is greater in a high pressure resistance transistor than in a low pressure resistance transistor. In other words, the feedthrough noise described above further increases in the transfer gate by the high pressure resistance transistor.

As described above, there is a problem that feedthrough noise dependent on a voltage of the input signal in the transfer gate is generated. In other words, there is a problem that the amount of charge of feedthrough noise changes according to a voltage of the input signal, and charge discharge and charge injection are also switched. The present exemplary embodiment that can solve such a problem will be described below.

2. First Configuration Example of Switch Circuit

Figure 5:
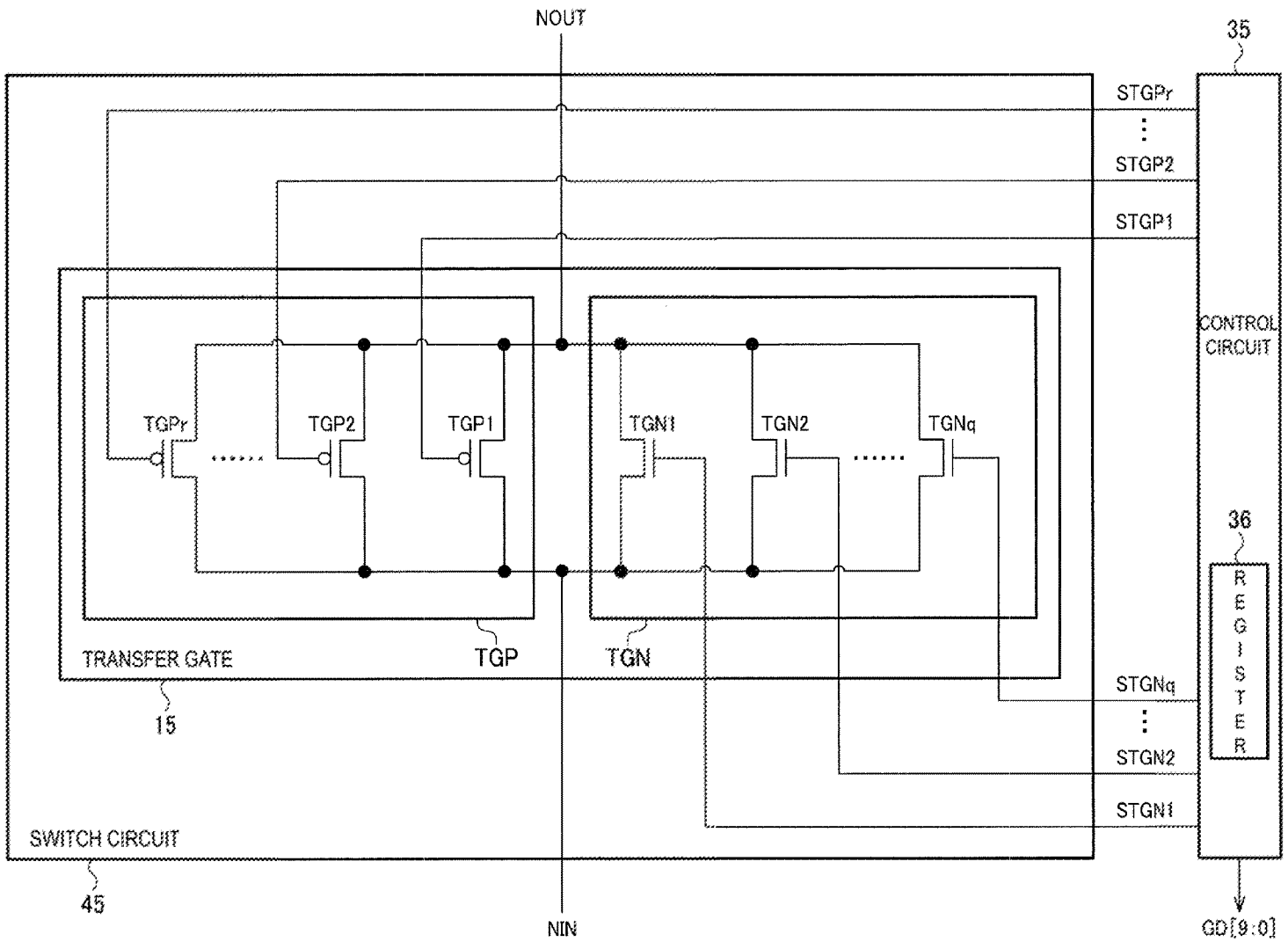
FIG. 5 is a first configuration example of a switch circuit.

FIG. 5 is a first configuration example of the switch circuit 45. The switch circuit 45 includes the transfer gate 15.

The transfer gate 15 includes a P-type transistor TGP and an N-type transistor TGN coupled in parallel between the input node NIN and the output node NOUT. In other words, one of a source and a drain of the P-type transistor TGP and one of a source and a drain of the N-type transistor TGN are coupled to the input node NIN. The other of the source and the drain of the P-type transistor TGP and the other of the source and the drain of the N-type transistor TGN are coupled to the output node NOUT. The input signal is input to the input node NIN of the transfer gate 15. When the transfer gate 15 is on, the transfer gate 15 passes the input signal and outputs the output signal to the output node NOUT.

The control circuit 35 controls a transistor size ratio of the transfer gate 15. The transistor size ratio is a ratio of the size of the P-type transistor TGP to the size of the N-type transistor TGN. The transistor size is a gate size of the transistor. The control circuit 35 performs control for setting the transistor size ratio to a first value when a voltage of the input signal is in a first voltage range at a timing at which the transfer gate 15 is turned off. The control circuit 35 performs control for setting the transistor size ratio to a second value when a voltage of the input signal is in a second voltage range at the timing at which the transfer gate 15 is turned off. The second value is greater than the first value.

The first voltage range is a voltage range of 5V to 12.5V higher than 5V in the example in FIG. 4, for example. In other words, the first voltage range is a voltage range in which charge is injected into the output node NOUT when the transfer gate is turned off in a case in which the P-type transistor and the N-type transistor of the transfer gate have the same size. Further, the second voltage range is a voltage range of 5V to 2.5V lower than 5V in the example in FIG. 4, for example. In other words, the second voltage range is a voltage range in which charge is discharged from the output node NOUT when the transfer gate is turned off in a case in which the P-type transistor and the N-type transistor of the transfer gate have the same size. Note that the first voltage range and the second voltage range may be arbitrarily set. For example, 7.5V to 12.5V higher than the common voltage of 7.5V may be set to be the first voltage range, and 7.5V to 2.5V lower than the common voltage of 7.5V may be set to be the second voltage range.

The control circuit 35 determines a voltage range to which a voltage of the input signal belongs, based on the display data GD [9:0] output to the output circuit 85. Since the output circuit 85 outputs a voltage corresponding to the display data GD [9:0] to the input node NIN of the transfer gate 15, the control circuit 35 can determine a voltage of the input signal from the display data GD [9:0].

According to the present exemplary embodiment, when a voltage of the input signal is in the first voltage range, the transistor size ratio is set to the first value. The "transistor size ratio is set to the first value" refers to that the size of the P-type transistor, the size of the N-type transistor, or both is set to the size corresponding to the first value. The transistor size ratio is set to the first value smaller than the second value, and thus a ratio of a parasitic capacitor of the P-type transistor to a parasitic capacitor of the N-type transistor becomes smaller. This corresponds to a reduction in the difference CDIF in the parasitic capacitor on the high voltage side in FIG. 3. In this way, the amount of charge injected into the output node NOUT by the transfer gate 15 is reduced.

Further, according to the present exemplary embodiment, when a voltage of the input signal is in the second voltage range, the transistor size ratio is set to the second value. The transistor size ratio is set to the second value greater than the first value, and thus a ratio of a parasitic capacitor of the P-type transistor to a parasitic capacitor of the N-type transistor becomes greater. This corresponds to a reduction in the difference CDIF in the parasitic capacitor on the low voltage side in FIG. 3. In this way, the amount of charge discharged from the output node NOUT by the transfer gate 15 is reduced.

As described above, according to the present embodiment, the amount of charge discharged from or injected into the output node NOUT by the transfer gate 15 can be reduced depending on a voltage of the input signal, and thus feedthrough noise generated by the transfer gate 15 is appropriately reduced.

A detailed configuration of the transfer gate 15 in the first configuration example will be described.

The P-type transistor TGP includes P-type sub-transistors TGP1 to TGPr that are a P-type sub-transistor group. r is an integer equal to or greater than 2. The P-type sub-transistors TGP1 to TGPr are coupled in parallel between the input node NIN and the output node NOUT. In other words, one of a source and a drain of the P-type sub-transistors TGP1 to TGPr is coupled to the input node NIN, and the other is coupled to the output node NOUT.

The N-type transistor TGN includes N-type sub-transistors TGN1 to TGNq that are an N-type sub-transistor group. q is an integer equal to or greater than 2. The N-type sub-transistors TGN1 to TGNq are coupled in parallel between the input node NIN and the output node NOUT. In other words, one of a source and a drain of the N-type sub-transistors TGN1 to TGNq is coupled to the input node NIN, and the other is coupled to the output node NOUT.

The control circuit 35 controls the size of the P-type transistor TGP by outputting control signals STGP1 to STGPr to a gate of the P-type sub-transistors TGP1*f* to TGPr. In other words, the control circuit 35 turns one or the plurality of P-type sub-transistors among the P-type sub-transistors TGP1 to TGPr off from on when the transfer gate 15 is turned off. In other words, the control circuit 35 controls a total transistor size of the P-type sub-transistor to be turned off from on.

Further, the control circuit 35 controls the size of the N-type transistor TGN by outputting control signals STGN1 to STGNq to a gate of the N-type sub-transistors TGN1 to TGNq. In other words, the control circuit 35 turns one or the plurality of N-type sub-transistors among the N-type sub-transistors TGN1 to TGNq off from on when the transfer gate 15 is turned off. In other words, the control circuit 35 controls a total transistor size of the N-type sub-transistor to be turned off from on.

The control circuit 35 controls the transistor size ratio, based on a ratio between the total transistor size of the P-type sub-transistor to be turned off from on and the total transistor size of the N-type sub-transistor to be turned off from on, when the transfer gate 15 is turned off.

The control circuit 35 includes a register 36 configured to store setting information about feedthrough noise reduction control. The setting information is information that designates a sub-transistor to be turned on and off in the P-type sub-transistor group and the N-type sub-transistor group. The control circuit 35 controls the transistor size ratio by outputting the control signals STGP1 to STGPr to the P-type sub-transistors TGP1 to TGPr and outputting the control signals STGN1 to STGNq to the N-type sub-transistors TGN1 to TGNq, based on the setting information stored in the register 36.

Figure 6:
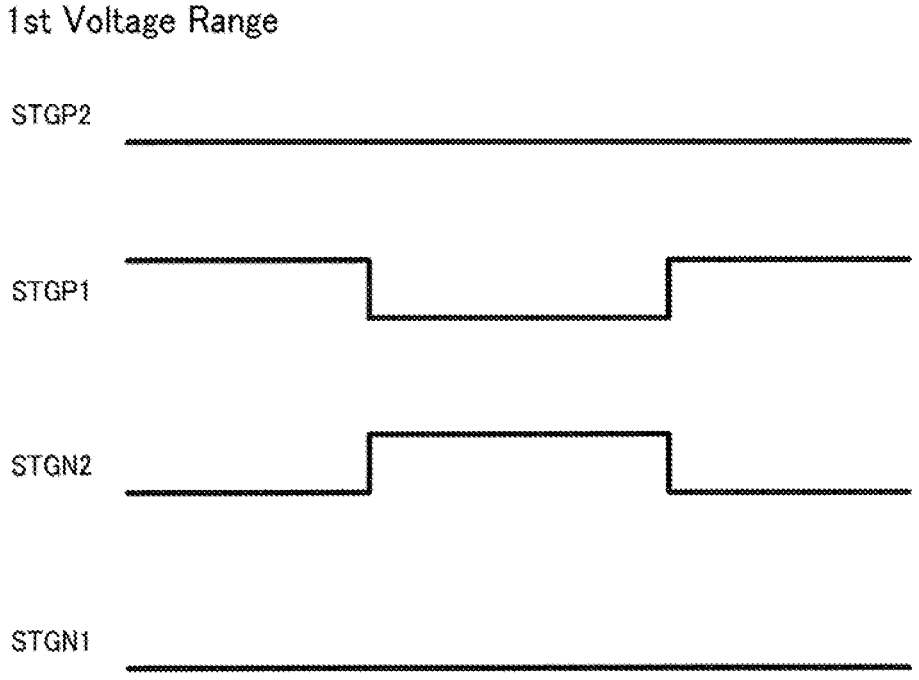
FIG. 6 is a waveform diagram illustrating a first operation example in the first configuration example of the switch circuit.
Figure 7:
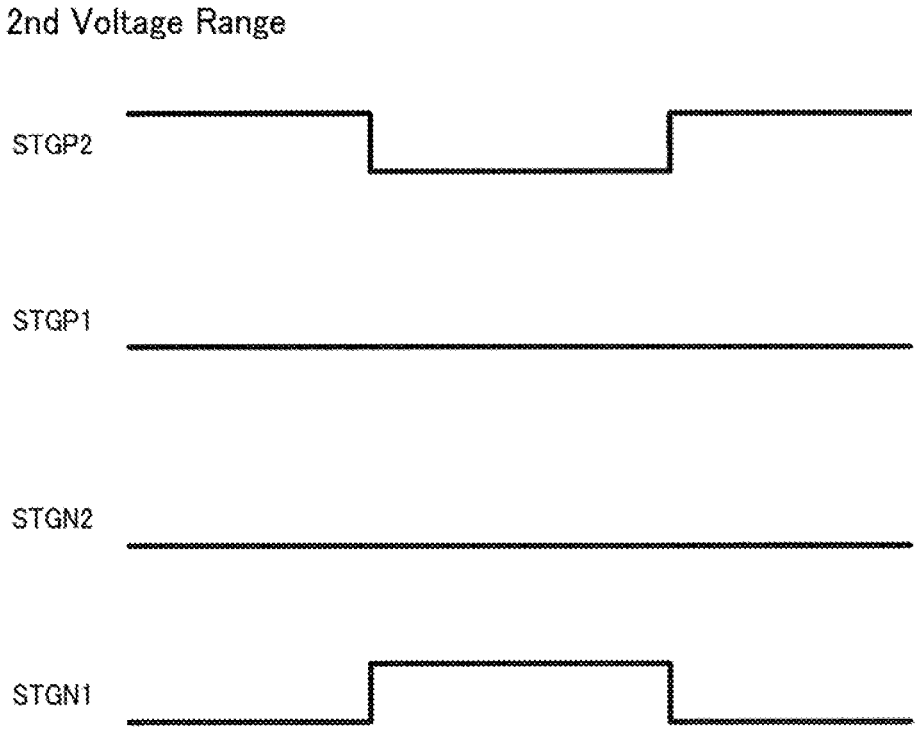
FIG. 7 is a waveform diagram illustrating the first operation example in the first configuration example of the switch circuit.

FIGS. 6 and 7 are each a waveform diagram illustrating a first operation example in the first configuration example of the switch circuit 45. Here, it is assumed that the first voltage range is set to 7.5V to 12.5V, the second voltage range is set to 7.5V to 2.5V, and q=r=2.

The P-type sub-transistor TGP1 that is a first P-type sub-transistor is larger in size than the P-type sub-transistor TGP2 that is a second P-type sub-transistor. For example, the P-type sub-transistors TGP1 and TGP2 have the same gate length, and a gate width of the P-type sub-transistor TGP1 is greater than a gate width of the P-type sub-transistor TGP2.

The N-type sub-transistor TGN1 that is a first N-type sub-transistor is larger in size than the N-type sub-transistor TGN2 that is a second N-type sub-transistor. For example, the N-type sub-transistors TGN1 and TGN2 have the same gate length, and a gate width of the N-type sub-transistor TGN1 is greater than a gate width of the N-type sub-transistor TGN2. For example, the sizes of the N-type sub-transistors TGN1 and TGN2 are the same as the sizes of the P-type sub-transistors TGP1 and TGP2, respectively.

FIG. 6 illustrates a waveform example when a voltage of the input signal of the transfer gate 15 is in the first voltage range. The control circuit 35 sets the control signal STGP1 from the low level to the high level and sets the control signal STGN2 from the high level to the low level at the timing at which the transfer gate 15 is turned off. As a result, the P-type sub-transistor TGP1 and the N-type sub-transistor TGN2 are turned off from on. An on/off state of the P-type sub-transistor TGP2 and the N-type sub-transistor TGN1 does not change.

FIG. 7 illustrates a waveform example when a voltage of the input signal of the transfer gate 15 is in the second voltage range. The control circuit 35 sets the control signal STGP2 from the low level to the high level and sets the control signal STGN1 from the high level to the low level at the timing at which the transfer gate 15 is turned off. As a result, the P-type sub-transistor TGP2 and the N-type sub-transistor TGN1 are turned off from on. An on/off state of the P-type sub-transistor TGP1 and the N-type sub-transistor TGN2 does not change.

According to the present exemplary embodiment, in the first voltage range, the P-type sub-transistor TGP1 of the smaller size in the P-type sub-transistor group and the N-type sub-transistor TGN2 of the larger size in the N-type sub-transistor group are turned off from on. As a result, the transistor size ratio becomes the first value. On the other hand, in the second voltage range, the P-type sub-transistor TGP2 of the larger size in the P-type sub-transistor group and the N-type sub-transistor TGN1 of the smaller size in the N-type sub-transistor group are turned off from on. As a result, the transistor size ratio becomes the second value greater than the first value.

FIG. 8 is an example of a size of the P-type sub-transistor and the N-type sub-transistor. Here, it is assumed that q=r=4. FIG. 8 illustrates W/L as the transistor size. W is a gate width, and L is a gate length. Since the gate length L is 3.2 um, which is common, the transistor size will be described below with the gate width W.

In FIG. 8, the P-type sub-transistor TGP1 and the N-type sub-transistor TGN1 have the same size. Similarly, the P-type sub-transistors TGP2, TGP3, and TGP4, and the N-type sub-transistors TGN2, TGN3, and TGN4 have the same size. The size of the P-type sub-transistor will be described below, but the same also applies to the size of the N-type sub-transistor.

FIG. 8 illustrates Example 1 to Example 3 of the transistor size. In all of the examples, a total of gate widths of the P-type sub-transistors TGP1 to TGP4 is 72 um. How the total of 72 um is assigned to each of the P-type sub-transistors varies from Example 1 to Example 3.

In Example 1, a gate width of the sub-transistor is weighted to a binary. However, since a gate width of each of the sub-transistors is adjusted in such a way that a total of the gate widths of the sub-transistors is 72 um, the gate width is not completely a binary. Specifically, a gate width of the P-type sub-transistor TGP3 is a value slightly greater than approximately a half of a gate width of the P-type sub-transistor TGP4. Similarly, gate widths of the P-type sub-transistors TGP2 and TGP1 are a value slightly greater than approximately a half of gate widths of the P-type sub-transistors TGP3 and TGP2.

In Example 2, a gate width of the sub-transistor is different by a predetermined step. In FIG. 8, the predetermined step is 4 um. Specifically, a gate width of the P-type sub-transistor TGP2 is greater than a gate width of the P-type sub-transistor TGP1 by 4 um. Similarly, gate widths of the P-type sub-transistors TGP3 and TGP4 are greater than gate widths of the P-type sub-transistors TGP2 and TGP3 by 4 um.

In Example 3, the sub-transistors have the same gate width. Specifically, a gate width of the P-type sub-transistor TGP1 is 18 um. The P-type sub-transistors TG2 to TG4 have a gate width of 18 um that is the same as that of the P-type sub-transistor TGP1.

FIG. 9 is a diagram illustrating a second operation example in the first configuration example of the switch circuit 45. FIG. 9 illustrates an example of a register setting value stored in the register 36. It is assumed that the transistor size is the size illustrated in Example 1 in FIG. 8. Here, it is assumed that the first voltage range is set to 10 to 12.5V, a third voltage range is set to 7.5 to 10V, a fourth voltage range is set to 5 to 7.5V, and the second voltage range is set to 2.5 to 5V. Note that the third voltage range may be a voltage range lower than the first voltage range and higher than the second voltage range, and the fourth voltage range may be a voltage range lower than the third voltage range and higher than the second voltage range.

A register value is an enable signal corresponding to each of the sub-transistors. An enable signal "1" indicates that the sub-transistor is turned on and off when the transfer gate 15 is turned on and off. An enable signal "0" indicates that the sub-transistor is not turned on and off when the transfer gate 15 is turned on and off.

In the first voltage range, the P-type sub-transistors TGP1 and TGP3 and the N-type sub-transistors TGN1 to TGN4 are turned on and off when the transfer gate 15 is turned on and off. A total gate width of the P-type sub-transistors TGP1 and TGP3 is 26 um, and a total gate width of the N-type sub-transistors TGN1 to TGN4 is 72 um. A transistor size ratio is 26 um/72 um. In this example, 26 um/72 um is the first value.

In the third voltage range, the P-type sub-transistors TGP1 and TGP4 and the N-type sub-transistors TGN1 to TGN4 are turned on and off when the transfer gate 15 is turned on and off. A transistor size ratio is 42 um/72 um. In this example, 42 um/72 um is a third value.

In the fourth voltage range, the P-type sub-transistors TGP2 to TGP4 and the N-type sub-transistors TGN1 to TGN4 are turned on and off when the transfer gate 15 is turned on and off. A transistor size ratio is 66 um/72 um. In this example, 66 um/72 um is a fourth value.

In the second voltage range, the P-type sub-transistors TGP1 to TGP4 and the N-type sub-transistors TGN1, TGN2, and TGN4 are turned on and off when the transfer gate 15 is turned on and off. A transistor size ratio is 72 um/52 um. In this example, 72 um/52 um is the second value.

As described above, the transistor size ratio corresponding to the third voltage range is greater than the transistor size ratio corresponding to the first voltage range. In other words, the third value is greater than the first value. Further, the transistor size ratio corresponding to the fourth voltage range is greater than the transistor size ratio corresponding to the third voltage range. In other words, the fourth value is greater than the third value. Further, the transistor size ratio corresponding to the second voltage range is greater than the transistor size ratio corresponding to the fourth voltage range. In other words, the second value is greater than the fourth value. Note that it is desirable that the transistor size ratio corresponding to the first voltage range is less than 1. It is also desirable that the transistor size ratio corresponding to the second voltage range is greater than 1.

As described above, by various combinations of sub-transistors to be turned on and off when the transfer gate 15 is turned off, feedthrough noise dependent on a voltage of the input signal can be appropriately compensated for. Specifically, a transistor size ratio of the transfer gate 15 becomes smaller with a voltage range of a higher voltage, and a transistor size ratio of the transfer gate 15 becomes greater with a voltage range of a lower voltage. As a result, a parasitic capacitance of the P-type transistor of the transfer gate 15 and a parasitic capacitance of the N-type transistor can be balanced according to a voltage of the input signal. The balanced parasitic capacitance reduces feedthrough noise.

3. Second Configuration Example of Switch Circuit

Figure 10:
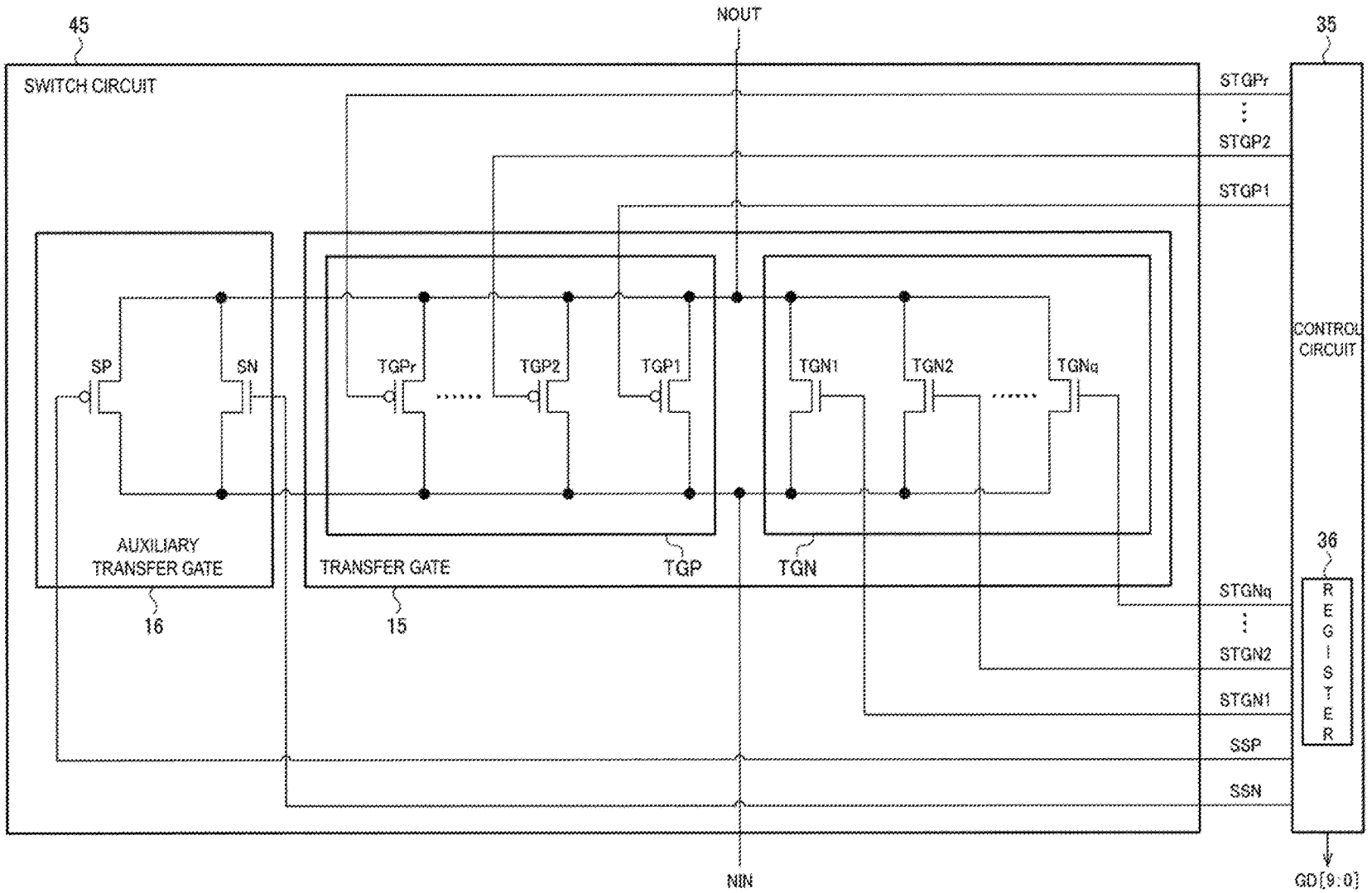
FIG. 10 is a second configuration example of the switch circuit.

FIG. 10 is a second configuration example of the switch circuit 45. The switch circuit 45 includes the transfer gate 15 and an auxiliary transfer gate 16. A configuration of the transfer gate 15 is the same as that in the first configuration example.

The auxiliary transfer gate 16 includes a P-type auxiliary transistor SP and an N-type auxiliary transistor SN. The P-type auxiliary transistor SP and the N-type auxiliary transistor SN are coupled in parallel with the transfer gate 15. In other words, one of a source and a drain of the P-type auxiliary transistor SP is coupled to the input node NIN, and the other is coupled to the output node NOUT. One of a source and a drain of the N-type auxiliary transistor SN is coupled to the input node NIN, and the other is coupled to the output node NOUT.

A total transistor size of the auxiliary transfer gate 16 is smaller than a total transistor size of the transfer gate 15. In other words, a size of the P-type auxiliary transistor SP is smaller than a total size of the P-type sub-transistors TGP1 to TGPr. A size of the N-type auxiliary transistor SN is smaller than a total size of the N-type sub-transistors TGN1 to TGNq. For example, a size of the P-type auxiliary transistor SP is equal to or less than ½ of a total size of the P-type sub-transistors TGP1 to TGPr, and a size of the N-type auxiliary transistor SN is equal to or less than ½ of a total size of the N-type sub-transistors TGN1 to TGNq.

The control circuit 35 controls the auxiliary transfer gate 16. In other words, the control circuit 35 controls on and off of the P-type auxiliary transistor SP by outputting a control signal SSP to a gate of the P-type auxiliary transistor SP. The control circuit 35 controls on and off of the N-type auxiliary transistor SN by outputting a control signal SSN to a gate of the N-type auxiliary transistor SN.

Figure 11:
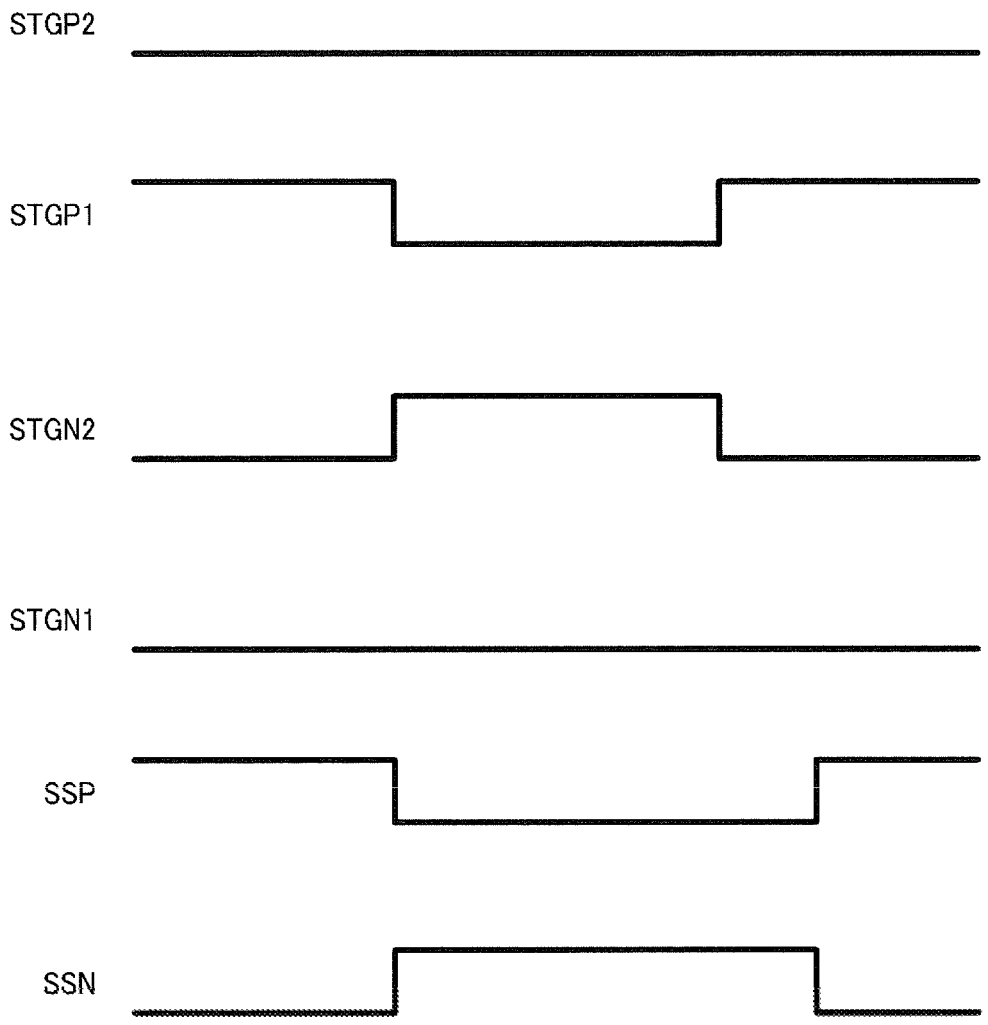
FIG. 11 is a waveform diagram illustrating an operation in the second configuration example of the switch circuit.

FIG. 11 is a waveform diagram illustrating an operation in the second configuration example of the switch circuit 45. Here, it is assumed that q=r=2. In FIG. 11, an operation of the auxiliary transfer gate 16 will be described by taking, as an example, the operation of the transfer gate 15 in the first voltage range described in FIG. 6. Note that, in the second to fourth voltage ranges, an operation of the auxiliary transfer gate 16 is also the same.

The control circuit 35 controls the auxiliary transfer gate 16 to be turned off from on after the transfer gate 15 is turned off from on.

Specifically, the control circuit 35 sets the control signal STGP1 from the high level to the low level, and sets the control signal STGN2 from the low level to the high level, and thus turns the P-type sub-transistor TGP1 and the N-type sub-transistor TGN2 on from off. At this timing, the control circuit 35 sets the control signal SSP from the high level to the low level, and sets the control signal SSN from the low level to the high level, and thus turns the P-type auxiliary transistor SP and the N-type auxiliary transistor SN on from off.

Next, the control circuit 35 sets the control signal STGP1 from the low level to the high level, and sets the control signal STGN2 from the high level to the low level, and thus turns the P-type sub-transistor TGP1 and the N-type sub-transistor TGN2 off from on. At a timing after this timing, the control circuit 35 sets the control signal SSP from the low level to the high level, and sets the control signal SSN from the high level to the low level, and thus turns the P-type auxiliary transistor SP and the N-type auxiliary transistor SN off from on.

The auxiliary transfer gate 16 is turned off after the transfer gate 15 is turned off, and thus feedthrough noise of the output node NOUT can escape to the input node NIN via the auxiliary transfer gate 16. The feedthrough noise is reduced by controlling a transistor size ratio of the transfer gate 15, and the feedthrough noise can be further reduced by using the auxiliary transfer gate 16.

Further, since the size of the auxiliary transfer gate 16 is smaller than the size of the transfer gate 15, the feedthrough noise generated by the auxiliary transfer gate 16 is smaller than the feedthrough noise generated by the transfer gate 15. Thus, when the auxiliary transfer gate 16 is turned off, an influence of the feedthrough noise is small.

In the circuit device 100 in FIG. 1, the capacitor circuit 82 is coupled to the input node NIN of the transfer gate 15, and the input node of the amplifier circuit 80 is coupled to the output node NOUT of the transfer gate 15. Since a capacitor of the capacitor circuit 82 is greater than a parasitic capacitor of the input node of the amplifier circuit 80, the input node NIN of the transfer gate 15 is less likely to be affected by the feedthrough noise. In the present exemplary embodiment, by turning off the auxiliary transfer gate 16 with a delay, the feedthrough noise can be absorbed by the capacitor circuit 82 via the auxiliary transfer gate 16, and the feedthrough noise of the output node NOUT can be effectively reduced.

4. Second Configuration Example of Circuit Device

Figure 12:
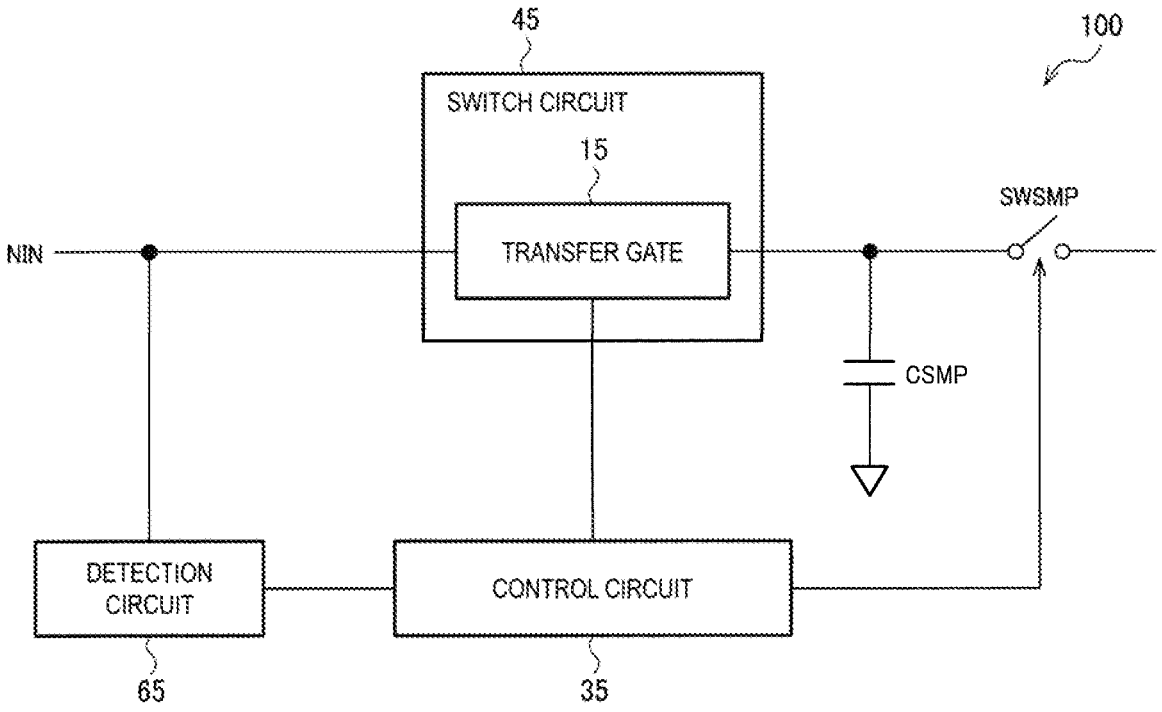
FIG. 12 is a second configuration example of the circuit device.

Although the case in which the switch circuit 45 is applied to the display driver has been described above as an example, the switch circuit 45 can be applied to various circuit devices. As one example, FIG. 12 illustrates a second configuration example of the circuit device 100. In the second configuration example, the switch circuit 45 is applied to the sample hold circuit. The sample hold circuit is used in, for example, an input unit of an A/D converter circuit or an input unit of a switched capacitor filter.

The circuit device 100 illustrated in FIG. 12 includes the control circuit 35, the switch circuit 45, a detection circuit 65, a capacitor CSMP, and a switch SWSMP. The switch circuit 45 includes the transfer gate 15. Note that, when the switch circuit 45 is in the second configuration example described above, the switch circuit 45 further includes the auxiliary transfer gate 16.

During a sampling period, the control circuit 35 turns on the transfer gate 15 and turns off the switch SWSMP. As a result, the input signal input to the input node NIN of the transfer gate 15 is sampled by the capacitor CSMP coupled to the output node NOUT of the transfer gate 15. During a hold period, the control circuit 35 turns off the transfer gate 15 and turns on the switch SWSMP. As a result, the input signal is held by the capacitor CSMP, and the held signal is output via the switch SWSMP.

The control circuit 35 performs feedthrough noise reduction control by controlling the transistor size ratio of the transfer gate 15. This feedthrough noise reduction control is as described in the first and second configuration examples of the switch circuit 45.

The detection circuit 65 detects a voltage range to which a voltage of the input signal input to the input node NIN belongs. For example, the detection circuit 65 is a comparator that compares the voltage of the input signal with a reference voltage for detecting the voltage range. The control circuit 35 outputs a control signal to the transfer gate 15 according to the voltage range detected by the detection circuit 65. The transfer gate 15 is switched based on the control signal.

5. Calibration

Calibration of a feedthrough noise reduction will be described. For example, during initialization when the power of the circuit device 100 is turned on, the circuit device 100 performs calibration, and stores, in the register 36, the result as setting information about a feedthrough noise reduction.

Figure 13:
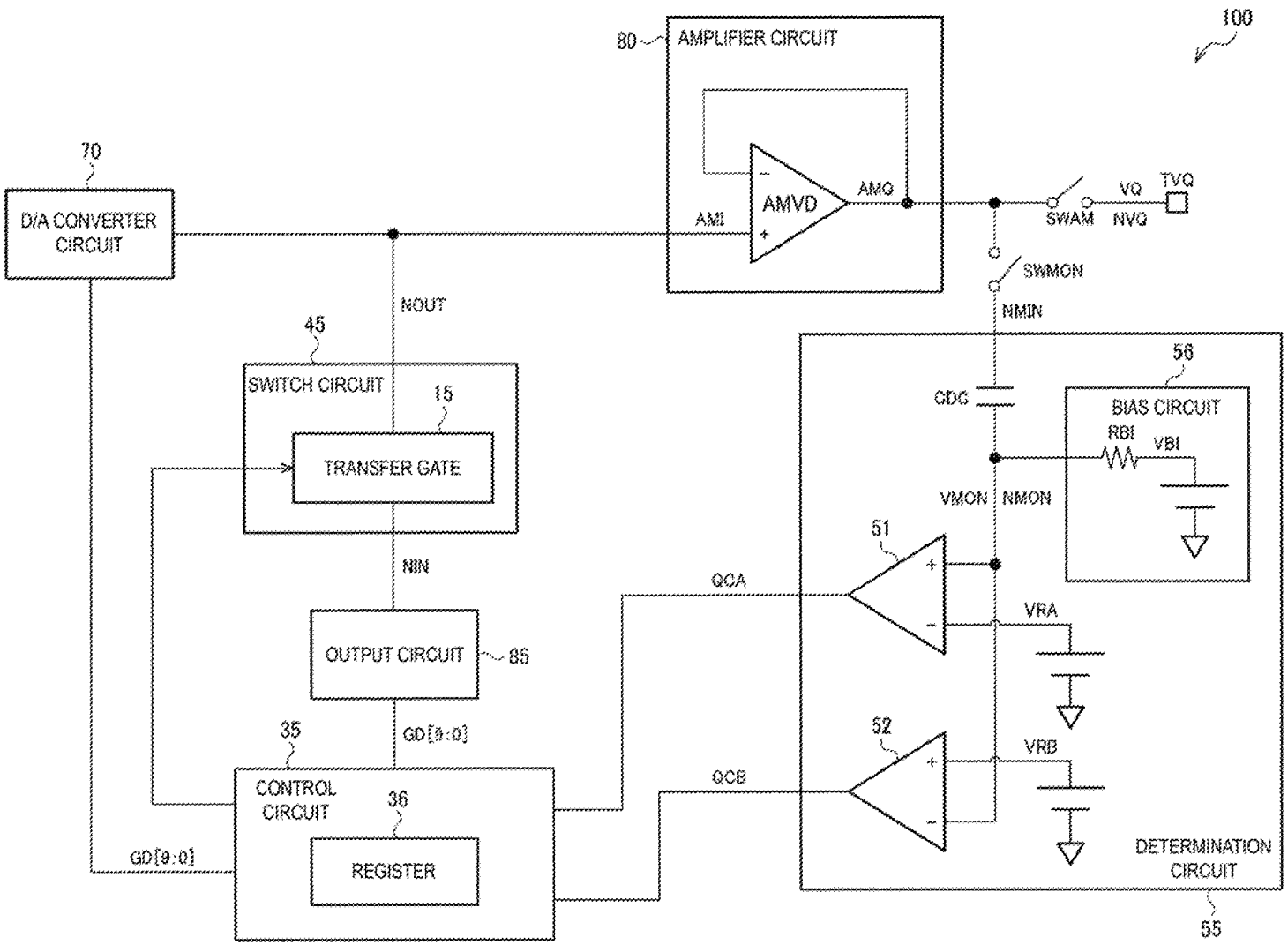
FIG. 13 is a third configuration example of the circuit device.

FIG. 13 is a third configuration example of the circuit device 100. The circuit device 100 includes the control circuit 35, the switch circuit 45, a determination circuit 55, the D/A converter circuit 70, the amplifier circuit 80, the output circuit 85, the switch SWAM, and a switch SWMON. SWMON is also referred to as a determination switch. Note that, in FIG. 13, illustration of the reference voltage generation circuit 60 is omitted. Note that the components that are the same as the components already described have the same reference numerals, and description of the components will be appropriately omitted.

The amplifier circuit 80 is a voltage follower circuit constituted of the operational amplifier AMVD. The switch SWMON is coupled between the output terminal of the operational amplifier AMVD and an input node NMIN of the determination circuit 55. The switch SWMON is a switch constituted of a transistor.

The determination circuit 55 determines feedthrough noise of the transfer gate 15 output to the output terminal of the operational amplifier AMVD. In other words, feedthrough noise generated by the transfer gate 15 passes through the operational amplifier AMVD from the non-inverting input terminal of the operational amplifier AMVD, and is output to the output terminal of the operational amplifier AMVD. The feedthrough noise output to the output terminal is a signal affected by a frequency characteristic of the operational amplifier AMVD and the like. An influence of feedthrough noise on the output side of the operational amplifier AMVD may be able to be reduced, and thus the determination circuit 55 determines the feedthrough noise on the output side of the operational amplifier AMVD.

The control circuit 35 performs noise reduction control for reducing feedthrough noise on the switch circuit 45, based on a determination result of the determination circuit 55. Specifically, the control circuit 35 causes the register 36 to store setting information about a feedthrough noise reduction, based on a determination result. Then, during a normal operation of the circuit device 100, that is, when the circuit device 100 drives the electro-optical panel, the control circuit 35 performs feedthrough noise reduction control on the transfer gate 15, based on the setting information stored in the register 36. The feedthrough noise reduction control is as described in FIGS. 1 to 12.

According to the present exemplary embodiment, the determination circuit 55 can determine feedthrough noise that varies according to a voltage of the input signal of the transfer gate 15. Then, the control circuit 35 performs the feedthrough noise reduction control, based on the determination result, and thus the feedthrough noise that fluctuates according to the voltage of the input signal of the transfer gate 15 can be appropriately reduced.

Details of the determination circuit 55 will be described below. The determination circuit 55 includes a capacitor CDC being a DC cut capacitor, a bias circuit 56, a comparator 51 being a first comparison circuit, and a comparator 52 being a second comparison circuit.

The capacitor CDC is provided between the input node NMIN and a determination node NMON of the determination circuit 55. In other words, one end of the capacitor CDC is coupled to the input node NMIN, and the other end is coupled to the determination node NMON.

The bias circuit 56 sets the determination node NMON to a bias voltage VBI. The bias circuit 56 includes a resistor RBI coupled between the node of the bias voltage VBI and the determination node NMON. The bias voltage VBI is input to the determination node NMON through the resistor RBI.

The comparator 51 compares a voltage VMON of the determination node NMON with a determination voltage VRA, and outputs the result as an output signal QCA. The determination voltage VRA is a first determination voltage and is higher than the bias voltage VBI by a predetermined width ΔV. The comparator 52 compares the voltage VMON of the determination node NMON with a determination voltage VRB, and outputs the result as an output signal QCB. The determination voltage VRB is a second determination voltage and is lower than the bias voltage VBI by the predetermined width ΔV. 2×ΔV is a voltage width corresponding to an allowable amplitude of feedthrough noise. For example, ΔV=10 mV, which is not limited thereto.

Figure 14:
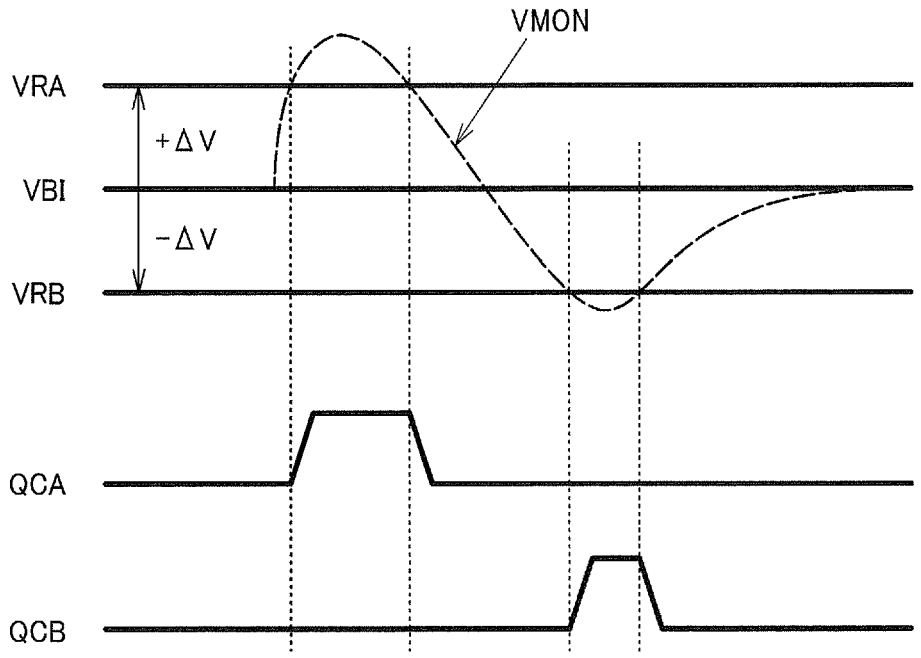
FIG. 14 is a waveform diagram illustrating an operation of a determination circuit.
Figure 15:
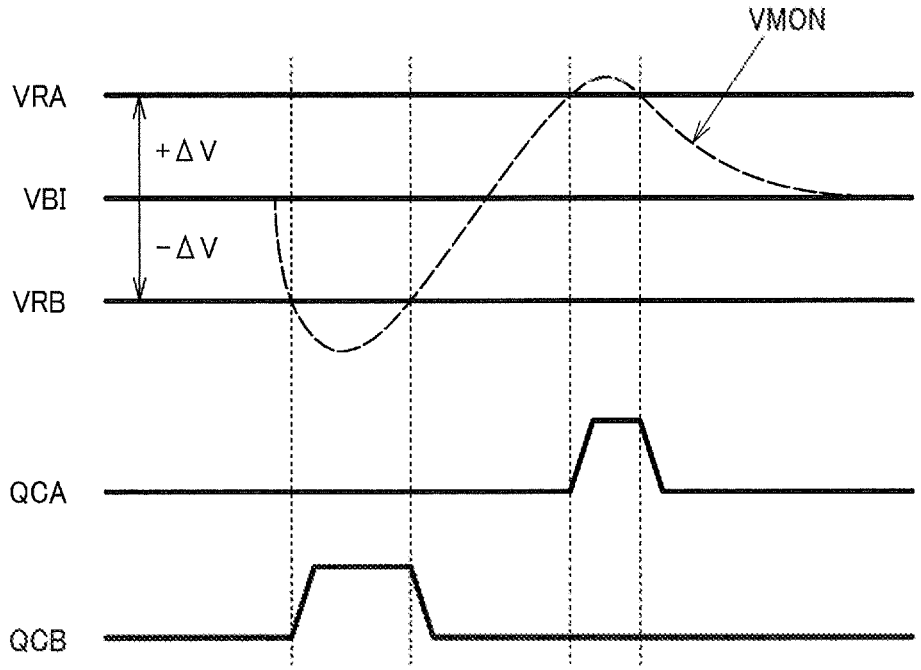
FIG. 15 is a waveform diagram illustrating an operation of the determination circuit.

FIGS. 14 and 15 are each a waveform diagram illustrating an operation of the determination circuit 55. A waveform of the voltage VMON illustrated in FIGS. 14 and 15 is a waveform of feedthrough noise when the transfer gate 15 is turned off from on.

FIG. 14 illustrates a waveform when a voltage of the input signal of the transfer gate 15 belongs to the first voltage range, that is, when the transfer gate 15 injects charge into the output node NOUT. Since the voltage VMON is DC-cut by the capacitor CDC and biased by the bias voltage VBI, feedthrough noise at the voltage VMON is only an AC component centered on the bias voltage VBI. The magnitude of the AC component is detected by the comparators 51 and 52.

In the example in FIG. 14, after the voltage VMON exceeds the determination voltage VRA, the voltage VMON falls below the determination voltage VRB. When the voltage VMON exceeds the determination voltage VRA, the output signal QCA of the comparator 51 is at the high level. When the voltage VMON falls below the determination voltage VRB, the output signal QCB of the comparator 52 is at the high level. A fluctuation in the voltage VMON due to feedthrough noise is a first fluctuation in a positive direction, and a subsequent fluctuation in a negative direction is a fluctuation due to a transient response of the operational amplifier AMVD and the like. Thus, the control circuit 35 performs calibration, based on the output signal QCA of the comparator 51 that first reaches the high level.

FIG. 15 illustrates a waveform when a voltage of the input signal of the transfer gate 15 belongs to the second voltage range, that is, when the transfer gate 15 discharges charge from the output node NOUT.

In the example in FIG. 15, after the voltage VMON falls below the determination voltage VRB, the voltage VMON exceeds the determination voltage VRA. When the voltage VMON falls below the determination voltage VRB, the output signal QCB of the comparator 52 is at the high level. When the voltage VMON exceeds the determination voltage VRA, the output signal QCA of the comparator 51 is at the high level. The control circuit 35 performs calibration, based on the output signal QCB of the comparator 52 that first reaches the high level.

Figure 16:
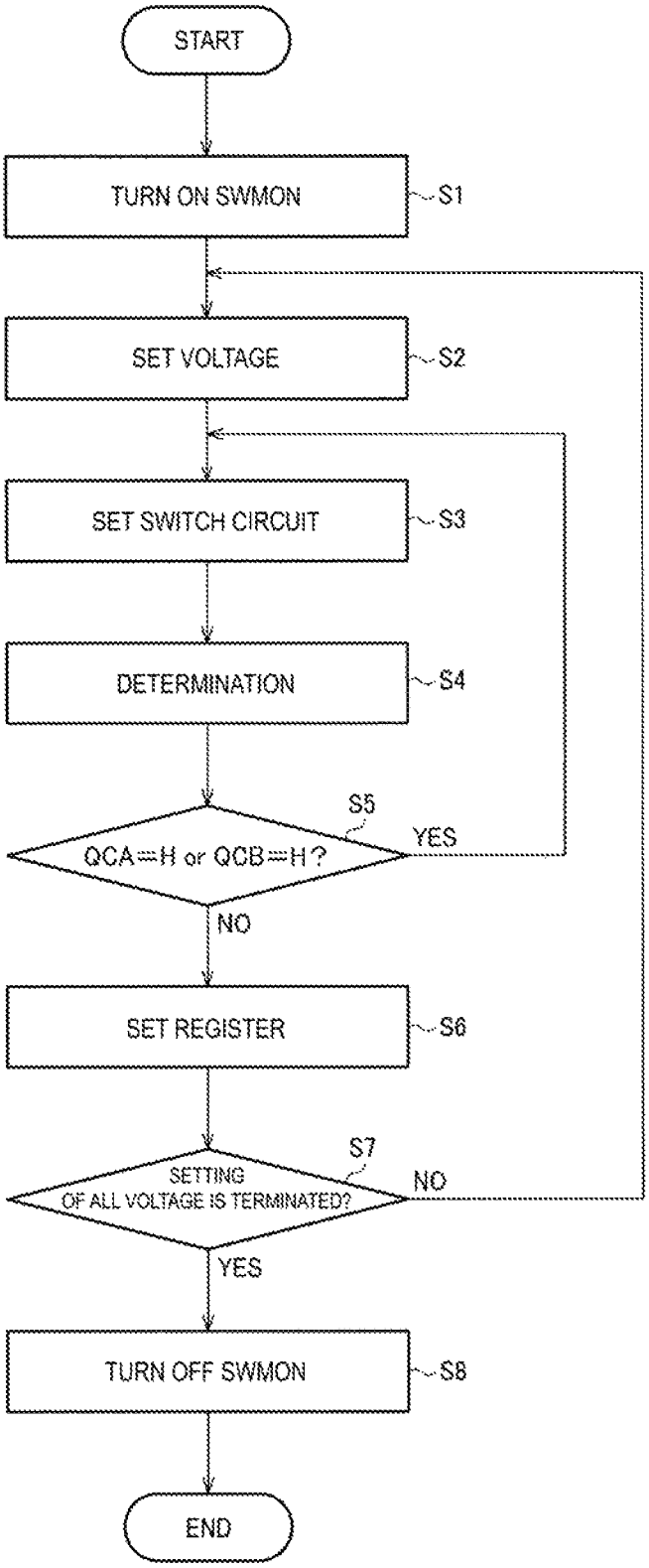
FIG. 16 is a flowchart illustrating a procedure of calibration.

FIG. 16 is a flowchart illustrating a procedure of calibration.

In step S1, the control circuit 35 turns on the switch SWMON. In step S2, the control circuit 35 sets a voltage of the input signal of the transfer gate 15. In other words, the control circuit 35 outputs the display data GD [9:0] corresponding to a voltage at which feedthrough noise is to be measured, to the D/A converter circuit 70 and the output circuit 85. For example, when a first voltage range is 7.5V to 12.5V, the control circuit 35 outputs the display data GD [9:0] corresponding to 10V that is a central value in the first voltage range.

In step S3, the control circuit 35 sets the switch circuit 45. In other words, the control circuit 35 sets an operation state of the transfer gate 15 to one certain operation state by writing setting information about a feedthrough noise reduction to the register 36. For example, when the present calibration technique is applied to the configuration example in FIG. 5, the control circuit 35 designates a transistor to be turned on and off among the P-type sub-transistors TGP1 to TGPr and the N-type sub-transistors TGN1 to TGNq.

In step S4, the determination circuit 55 determines feedthrough noise. In other words, the control circuit 35 operates the D/A converter circuit 70, the output circuit 85, and the switch circuit 45, thereby generating feedthrough noise when the transfer gate 15 is turned off. The determination circuit 55 determines a fluctuation in the voltage VMON due to the feedthrough noise, and outputs the output signals QCA and QCB that are the result.

In step S5, the control circuit 35 determines whether or not the output signal QCA or QCB has reached the high level in the determination operation in step S4. When the output signal QCA or QCB has reached the high level, the control circuit 35 returns to step S3. In step S3, the transfer gate 15 is set to an operation state different from the previous operation state. Then, the determination circuit 55 performs the determination operation in step S4 again. In step S5, when the output signal QCA or QCB has not reached the high level, the control circuit 35 causes the register 36 to hold setting information about a feedthrough noise reduction at that time in step S6.

In step S7, the control circuit 35 determines whether or not calibration has performed on all voltage ranges. When there is a voltage range on which calibration has not been performed, the control circuit 35 returns to step S2, sets a voltage of a next input signal, and performs steps S3 to S6 again. In step S7, when it is determined that calibration has been performed on all voltage ranges, the control circuit 35 turns off the switch SWMON and terminates the calibration.

Note that the configuration of the circuit device 100 including the determination circuit 55 is not limited to FIG. 15, and various modifications such as those described below can be made.

For example, the determination circuit 55 may determine feedthrough noise of the transfer gate 15 output to the input terminal of the operational amplifier AMVD. In other words, the switch SWMON may be coupled between the input terminal of the operational amplifier 55 and the input node NMIN of the determination circuit 55.

Alternatively, the amplifier circuit 80 may be an inverting amplifier circuit. A configuration example of the inverting amplifier circuit will be described in FIG. 17. The switch SWMON may be coupled between the output node or the input node of the amplifier circuit 80 being the inverting amplifier circuit, and the input node NMIN of the determination circuit 55. In this case, the output node of the amplifier circuit 80 is the output terminal of the operational amplifier AMVD, and the input node of the amplifier circuit 80 is the output node NOUT of the transfer gate 15.

Figure 17:
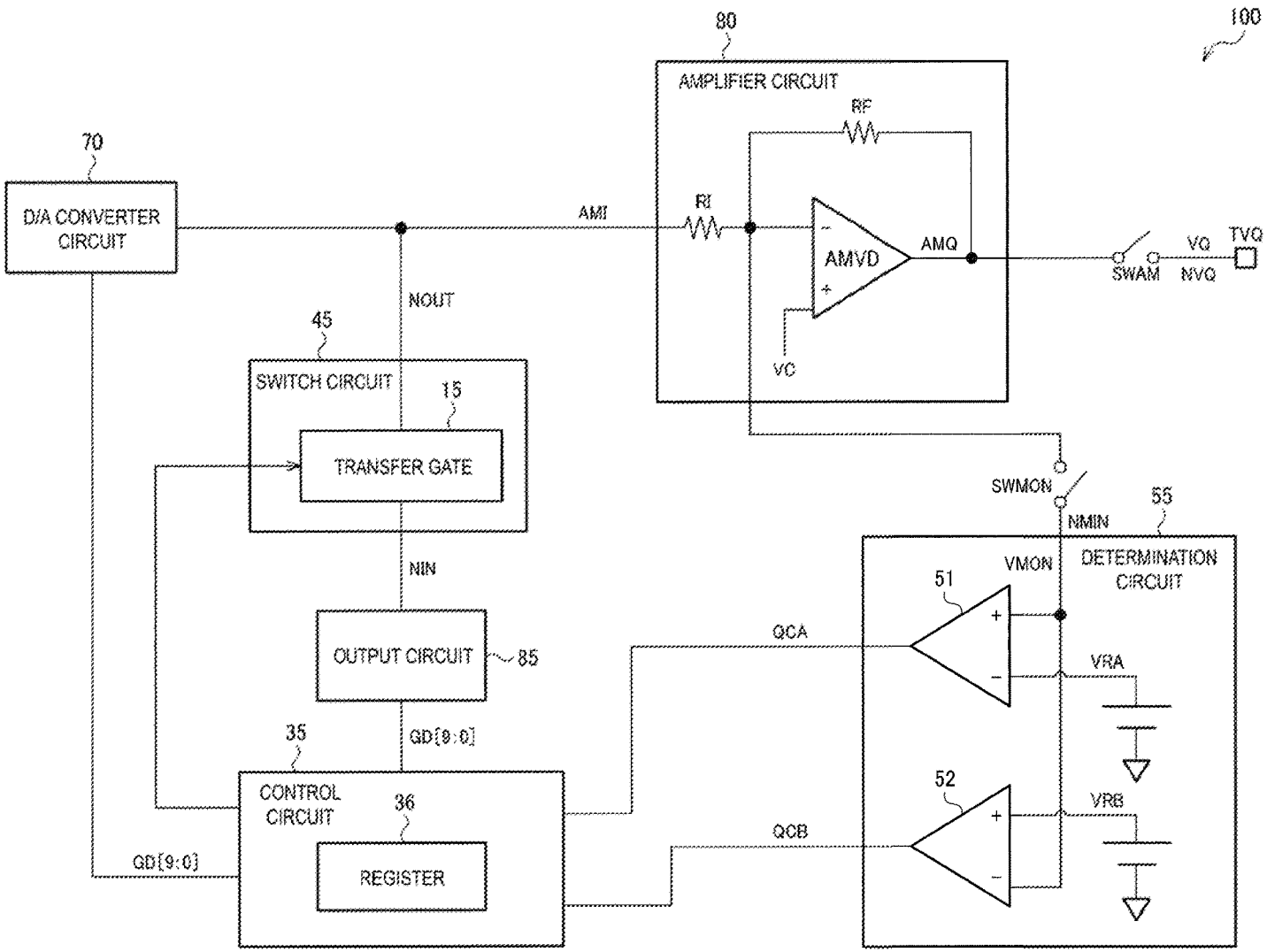
FIG. 17 is a fourth configuration example of the circuit device.

Alternatively, as in a fourth configuration example of the circuit device 100 illustrated in FIG. 17, the capacitor CDC being a DC cut capacitor may be omitted, and the switch SWMON may be coupled between the input terminal of the operational amplifier AMVD and the input node NMIN of the determination circuit 55.

Specifically, the amplifier circuit 80 includes the operational amplifier AMVD and resistors RI and RF. One end of the resistor RI is coupled to the output node NOUT of the transfer gate 15, and the other end is coupled to the inverting input terminal of the operational amplifier AMVD. One end of the resistor RF is coupled to the inverting input terminal of the operational amplifier AMVD, and the other end is coupled to the output terminal of the operational amplifier AMVD. A reference voltage VC is input to the non-inverting input terminal of the operational amplifier AMVD. The reference voltage VC corresponds to a common voltage when the electro-optical panel is driven.

The determination circuit 55 includes the comparators 51 and 52. In FIG. 17, the input node NMIN of the determination circuit 55 is a determination node. In other words, the comparator 51 compares the voltage VMON of the input node NMIN with the determination voltage VRA, and the comparator 52 compares the voltage VMON of the input node NMIN with the determination voltage VRB. The inverting input terminal of the operational amplifier AMVD becomes the reference voltage VC by a virtual short. Thus, feedthrough noise at the voltage VMON is only an AC component centered on the reference voltage VC. The magnitude of the AC component is detected by the comparators 51 and 52.

A calibration technique is similar to the technique described in FIGS. 13 to 16. In other words, the bias voltage VBI is replaced with the reference voltage VC in FIGS. 14 and 15, resulting in a waveform diagram in FIG. 17. The determination voltage VRA is higher than the reference voltage VC by ΔV, and the determination voltage VRB is lower than the reference voltage VC by ΔV. A procedure of calibration is similar to the procedure illustrated in FIG. 18.

6. Electro-Optical Device and Electronic Apparatus

Figure 18:
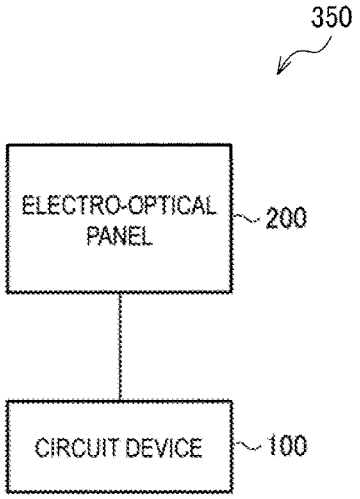
FIG. 18 is a configuration example of an electro-optical device.

FIG. 18 is a configuration example of an electro-optical device 350 including the circuit device 100. The electro-optical device 350 includes the circuit device 100 and an electro-optical panel 200. The circuit device 100 in FIG. 18 is a display driver.

The electro-optical panel 200 is, for example, an active matrix type liquid crystal display panel. For example, the circuit device 100 is mounted on a flexible substrate, the flexible substrate is coupled to the electro-optical panel 200, and the data voltage output terminal of the display driver 100 and the data voltage input terminal of the electro-optical panel 200 are coupled via a wiring line formed on the flexible substrate. Alternatively, the circuit device 100 may be mounted on a rigid substrate, the rigid substrate and the electro-optical panel 200 may be coupled via a flexible substrate, and the data voltage output terminal of the circuit device 100 and the data voltage input terminal of the electro-optical panel 200 may be coupled via a wiring line formed on the rigid substrate and the flexible substrate.

Figure 19:
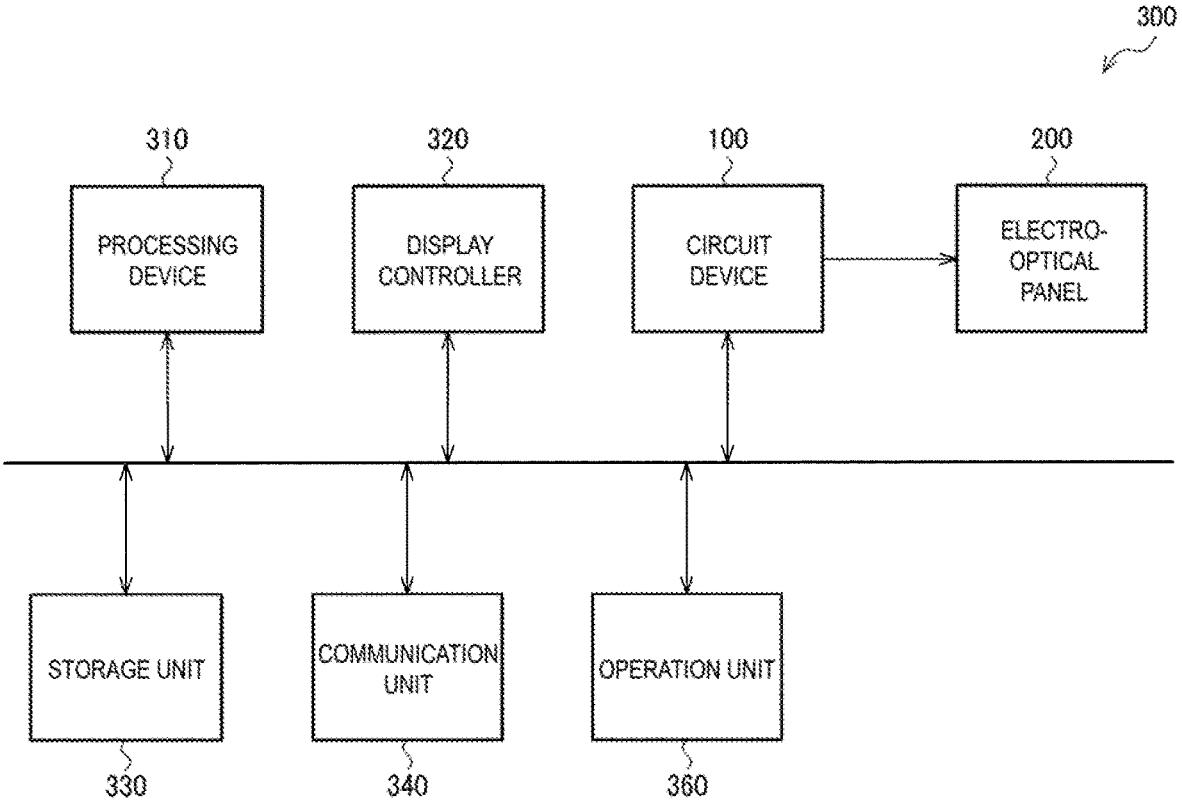
FIG. 19 is a configuration example of an electronic apparatus.

FIG. 19 is a configuration example of an electronic apparatus 300 including the circuit device 100. The electronic apparatus 300 includes a processing device 310, a display controller 320, the circuit device 100, the electro-optical panel 200, a storage unit 330, a communication unit 340, and an operation unit 360. The storage unit 330 is also called a storage device or memory. The communication unit 340 is also called a communication circuit or a communication device. The operation unit 360 is also called an operation device. In FIG. 19, a case in which the circuit device 100 is a display driver will be described as an example, but the circuit device 100 included in the electronic apparatus 300 is not limited to a display driver. For example, the electronic apparatus 300 may include the circuit device 100 including the sample hold circuit described in FIG. 12.

Specific examples of the electronic apparatus 300 may include various electronic apparatuses provided with display devices, such as a projector, a head-mounted display, a mobile information terminal, a vehicle-mounted device, a portable game terminal, and an information processing device. The vehicle-mounted device is, for example, a meter panel, a car navigation system, or the like.

The operating unit 360 is a user interface for various types of operations by a user. For example, the operating unit 360 is a button, a mouse, a keyboard, and/or a touch panel mounted on the electro-optical panel 200. The communication unit 340 is a data interface used for inputting and outputting image data and control data. Examples of the communication unit 340 include a wireless communication interface, such as a wireless LAN interface or a near field communication interface, and a wired communication interface, such as wired LAN interface or a USB interface. The storage unit 330, for example, stores data input from the communication unit 340 or functions as a working memory for the processing device 310. The storage unit 330 is, for example, a memory, such as a RAM or a ROM, a magnetic storage device, such as an HDD, or an optical storage device, such as a CD drive or a DVD drive. The display controller 320 processes image data input from the communication unit 340 or stored in the storage unit 330, and transfers the processed image data to the circuit device 100. The circuit device 100 displays an image on the electro-optical panel 200, based on the image data transferred from the display controller 320. The processing device 310 performs control processing for the electronic apparatus 300, various types of signal processing, and the like. The processing device 310 is, for example, a processor, such as a CPU or an MPU, or an ASIC.

For example, when the electronic apparatus 300 is a projector, the electronic apparatus 300 further includes a light source and an optical system. The optical system is, for example, a lens, a prism, a mirror, or the like. When the electro-optical panel 200 is of a transmissive type, the optical device emits light from the light source to the electro-optical panel 200, and the light transmitted through the electro-optical panel 200 is projected on a screen. When the electro-optical panel 200 is of a reflective type, the optical device emits light from the light source to the electro-optical panel 200, and the light reflected at the electro-optical panel 200 is projected on a screen.

The circuit device according to the present exemplary embodiment described above includes a transfer gate and a control circuit. The transfer gate includes a P-type transistor and an N-type transistor coupled in parallel between an input node and an output node. The transfer gate receives an input of an input signal to the input node, and the transfer gate outputs an output signal to the output node. The control circuit controls the transfer gate. The control circuit performs control so as to set, to a first value, a transistor size ratio being a ratio of a size of the P-type transistor to a size of the N-type transistor when a voltage of the input signal is in a first voltage range at a timing at which the transfer gate is turned off. The control circuit performs control so as to set the transistor size ratio to a second value greater than the first value when a voltage of the input signal is in a second voltage range lower than the first voltage range at a timing at which the transfer gate is turned off.

According to the present exemplary embodiment, when a voltage of the input signal is in the first voltage range, the transistor size ratio is set to the first value smaller than the second value, and thus a ratio of a parasitic capacitor of the P-type transistor to a parasitic capacitor of the N-type transistor becomes smaller. As a result, a difference in the parasitic capacitor between the N-type transistor and the P-type transistor in the first voltage range is reduced. Further, when a voltage of the input signal is in the second voltage range, the transistor size ratio is set to the second value greater than the first value, and thus a ratio of a parasitic capacitor of the P-type transistor to a parasitic capacitor of the N-type transistor becomes greater. As a result, a difference in the parasitic capacitor between the N-type transistor and the P-type transistor in the second voltage range is reduced. As described above, feedthrough noise dependent on a voltage of the input signal and generated by the transfer gate can be appropriately reduced according to the voltage of the input signal.

Further, in the present exemplary embodiment, the P-type transistor may include a P-type sub-transistor group coupled in parallel between the input node and the output node. The N-type transistor may include an N-type sub-transistor group coupled in parallel between the input node and the output node.

In this way, the control circuit can select a P-type sub-transistor to be turned on and off in the P-type sub-transistor group and an N-type sub-transistor to be turned on and off in the N-type sub-transistor group. As a result, the control circuit can control the transistor size ratio.

Further, in the present exemplary embodiment, the control circuit may control the transistor size ratio, based on a ratio between a total transistor size of a P-type sub-transistor to be turned off from on in the P-type sub-transistor group and a total transistor size of an N-type sub-transistor to be turned off from on in the N-type sub-transistor group.

A parasitic capacitance of the sub-transistor to be turned off from on in the sub-transistor group generates feedthrough noise. Thus, the control circuit controls a ratio between a total transistor size of a P-type sub-transistor to be turned off from on in the P-type sub-transistor group and a total transistor size of an N-type sub-transistor to be turned off from on in the N-type sub-transistor group, and thus a parasitic capacitance of the P-type sub-transistor and a parasitic capacitance of the N-type sub-transistor can be balanced. As a result, the feedthrough noise is reduced.

Further, in the present exemplary embodiment, the P-type sub-transistor group may include a first P-type sub-transistor, and a second P-type sub-transistor larger in size than the first P-type sub-transistor. The N-type sub-transistor group may include a first N-type sub-transistor, and a second N-type sub-transistor larger in size than the first N-type sub-transistor. The control circuit may perform control for turning the first P-type sub-transistor and the second N-type sub-transistor off from on when a voltage of the input signal is in the first voltage range at a timing at which the transfer gate is turned off. The control circuit may perform control for turning the second P-type sub-transistor and the first N-type sub-transistor off from on when a voltage of the input signal is in the second voltage range at a timing at which the transfer gate is turned off.

According to the present exemplary embodiment, in the first voltage range, the first P-type sub-transistor of the smaller size in the P-type sub-transistor group and the second N-type sub-transistor of the larger size in the N-type sub-transistor group are turned off from on. As a result, the transistor size ratio becomes the first value. On the other hand, in the second voltage range, the second P-type sub-transistor of the larger size in the P-type sub-transistor group and the first N-type sub-transistor of the smaller size in the N-type sub-transistor group are turned off from on. As a result, the transistor size ratio becomes the second value greater than the first value.

Further, in the present exemplary embodiment, the circuit device may further include an auxiliary transfer gate. The auxiliary transfer gate may include a P-type auxiliary transistor and an N-type auxiliary transistor. The P-type auxiliary transistor and the N-type auxiliary transistor may be coupled in parallel with the transfer gate between the input node and the output node. The control circuit may perform control for turning the auxiliary transfer gate off from on after the transfer gate is turned off from on.

In this way, the auxiliary transfer gate is turned off after the transfer gate is turned off, and thus feedthrough noise of the output node can escape to the input node via the auxiliary transfer gate. In the present exemplary embodiment, the feedthrough noise is reduced by controlling a transistor size ratio of the transfer gate, and the feedthrough noise can be further reduced by using the auxiliary transfer gate.

Further, in the present exemplary embodiment, a total transistor size of the auxiliary transfer gate may be smaller than a total transistor size of the transfer gate.

In this way, feedthrough noise generated by the auxiliary transfer gate is smaller than feedthrough noise generated by the transfer gate. Thus, an influence of the feedthrough noise when the auxiliary transfer gate is turned off can be reduced.

Further, in the present exemplary embodiment, the control circuit may set the transistor size ratio to a third value greater than the first value when a voltage of the input signal is in a third voltage range lower than the first voltage range and higher than the second voltage range at a timing at which the transfer gate is turned off.

In this way, when the control circuit sets the transistor size ratio of the transfer gate to a value smaller than the second value, the control circuit can more accurately control the transistor size ratio. As a result, parasitic capacitors of the P-type transistor and the N-type transistor can be accurately balanced according to each of the voltage ranges, and feedthrough noise is more appropriately reduced.

Further, in the present exemplary embodiment, the control circuit may set the transistor size ratio to a fourth value smaller than the second value when a voltage of the input signal is in a fourth voltage range higher than the second voltage range and lower than the third voltage range at a timing at which the transfer gate is turned off.

In this way, when the control circuit sets the transistor size ratio of the transfer gate to a value greater than the first value, the control circuit can more accurately control the transistor size ratio. As a result, parasitic capacitors of the P-type transistor and the N-type transistor can be accurately balanced according to each of the voltage ranges, and feedthrough noise is more appropriately reduced.

Further, in the present exemplary embodiment, the circuit device may further include an output circuit configured to output the input signal to the input node of the transfer gate, based on input data. The control circuit may determine, based on the input data, whether or not a voltage of the input signal belongs to the first voltage range and whether or not a voltage of the input signal belongs to the second voltage range.

Since the output circuit outputs the input signal to the input node of the transfer gate, based on the input data, the input data are data corresponding to a voltage of the input signal. As a result, the control circuit can determine, based on the input data, a voltage range to which a voltage of the input signal belongs.

Further, in the present exemplary embodiment, the circuit device may further include a D/A converter circuit and an amplifier circuit. The D/A converter circuit may output, to the output node of the transfer gate, a D/A conversion voltage acquired by performing D/A conversion on the input data. The amplifier circuit may receive an input of a signal of the output node of the transfer gate.

Feedthrough noise generated by the transfer gate affects accuracy of a signal output from the amplifier circuit. According to the present exemplary embodiment, since the control circuit performs feedthrough noise reduction control, the accuracy of a signal output from the amplifier circuit can be improved.

Further, in the present exemplary embodiment, when the transfer gate is on, the output signal corresponding to the input signal may be output to the output node of the transfer gate by the output circuit outputting the input signal to the input node of the transfer gate. After the transfer gate is turned off from on, the D/A converter circuit may output the D/A conversion voltage to the output node of the transfer gate.

Feedthrough noise generated by the transfer gate converges by the D/A converter circuit after the transfer gate is turned off. However, there is a possibility that feedthrough noise may not converge within a period in which the D/A converter circuit outputs the D/A conversion voltage. According to the present exemplary embodiment, since the control circuit performs feedthrough noise reduction control, the feedthrough noise can converge within tolerances within the period in which the D/A converter circuit outputs the D/A conversion voltage.

Further, in the present exemplary embodiment, the amplifier circuit may drive an electro-optical panel.

According to the present exemplary embodiment, accuracy of a signal output from the amplifier circuit can be improved by the control circuit performing feedthrough noise reduction control. As a result, accuracy of the data voltage that drives the electro-optical panel can be improved, and thus display quality is improved.

Further, an electro-optical device according to the present exemplary embodiment includes the circuit device described above, and the electro-optical panel.

Further, an electronic apparatus according to the present exemplary embodiment includes the circuit device according to any of the descriptions above.

Although the present exemplary embodiment has been described in detail above, those skilled in the art will easily understand that many modified examples can be made without substantially departing from novel items and effects of the present disclosure. All such modified examples are thus included in the scope of the disclosure. For example, terms in the descriptions or drawings given even once along with different terms having identical or broader meanings can be replaced with those different terms in all parts of the descriptions or drawings. All combinations of the exemplary embodiment and modified examples are also included within the scope of the disclosure. Furthermore, the configurations, operations, and the like of the circuit device, the electro-optical device, the electronic apparatus, and the like are not limited to those described in the exemplary embodiment, and various modifications thereof are possible.

What is claimed is:

1. A circuit device, comprising:

a transfer gate including a P-type transistor and an N-type transistor coupled in parallel between an input node and an output node, and being configured to input an input signal to the input node, and output an output signal to the output node; and a control circuit configured to control the transfer gate, wherein the control circuit performs control to set, as a first value, a transistor size ratio that is a ratio of a size of the P-type transistor to a size of the N-type transistor when a voltage of the input signal is in a first voltage range at a timing at which the transfer gate is turned off, and set the transistor size ratio as a second value greater than the first value when a voltage of the input signal is in a second voltage range lower than that in the first voltage range at a timing at which the transfer gate is turned off, the P-type transistor includes a P-type sub-transistor group coupled in parallel between the input node and the output node, the N-type transistor includes an N-type sub-transistor group coupled in parallel between the input node and the output node, the P-type sub-transistor group includes a first P-type sub-transistor, and a second P-type sub-transistor larger in size than the first P-type sub-transistor, the N-type sub-transistor group includes a first N-type sub-transistor, and a second N-type sub-transistor larger in size than the first N-type sub-transistor, and the control circuit performs control of turning the first P-type sub-transistor and the second N-type sub-transistor off from on when a voltage of the input signal is in the first voltage range at a timing at which the transfer gate is turned off, and performs control of turning the second P-type sub-transistor and the first N-type sub-transistor off from on when a voltage of the input signal is in the second voltage range at a timing at which the transfer gate is turned off.

2. The circuit device according to claim 1, wherein the control circuit controls the transistor size ratio by controlling a ratio between a total transistor size of a P-type sub-transistor, which is turned off from on, in the P-type sub-transistor group and a total transistor size of an N-type sub-transistor, which is turned off from on, in the N-type sub-transistor group.

3. The circuit device according to claim 1, comprising an auxiliary transfer gate including a P-type auxiliary transistor and an N-type auxiliary transistor coupled in parallel with the transfer gate between the input node and the output node, and the control circuit performs control of turning the auxiliary transfer gate off from on after the transfer gate is turned off from on.

4. The circuit device according to claim 3, wherein a total transistor size of the auxiliary transfer gate is smaller than a total transistor size of the transfer gate.

5. The circuit device according to claim 1, wherein the control circuit sets the transistor size ratio to a third value greater than the first value when a voltage of the input signal is in a third voltage range lower than that in the first voltage range and higher than that in the second voltage range at a timing at which the transfer gate is turned off.

6. The circuit device according to claim 5, wherein the control circuit sets the transistor size ratio to a fourth value smaller than the second value when a voltage of the input signal is in a fourth voltage range higher than that in the second voltage range and lower than that in the third voltage range at a timing at which the transfer gate is turned off.

7. The circuit device according to claim 1, comprising an output circuit configured to output the input signal to the input node, based on input data, wherein the control circuit determines, based on the input data, whether a voltage of the input signal belongs to the first voltage range and whether a voltage of the input signal belongs to the second voltage range.

8. The circuit device according to claim 7, comprising:

a D/A converter circuit configured to output, to the output node, a D/A conversion voltage acquired by performing D/A conversion on the input data; and an amplifier circuit configured to receive a signal of the output node.

9. The circuit device according to claim 8, wherein when the transfer gate is on, the output signal corresponding to the input signal is output to the output node, with the output circuit outputting the input signal to the input node, and after the transfer gate is turned off from on, the D/A converter circuit outputs the D/A conversion voltage to the output node.

10. The circuit device according to claim 8, wherein the amplifier circuit drives an electro-optical panel.

11. An electro-optical device, comprising:

the circuit device according to claim 10; and the electro-optical panel.

12. An electronic apparatus comprising the circuit device according to claim 1.

13. A circuit device, comprising:

a transfer gate including a P-type transistor and an N-type transistor coupled in parallel between an input node and an output node, and being configured to input an input signal to the input node, and output an output signal to the output node; and a control circuit configured to control the transfer gate, wherein the control circuit performs control to set, as a first value, a transistor size ratio that is a ratio of a size of the P-type transistor to a size of the N-type transistor when a voltage of the input signal is in a first voltage range at a timing at which the transfer gate is turned off, and set the transistor size ratio as a second value greater than the first value when a voltage of the input signal is in a second voltage range lower than that in the first voltage range at a timing at which the transfer gate is turned off, and the control circuit sets the transistor size ratio to a third value greater than the first value when a voltage of the input signal is in a third voltage range lower than that in the first voltage range and higher than that in the second voltage range at a timing at which the transfer gate is turned off.

14. A circuit device, comprising:

a transfer gate including a P-type transistor and an N-type transistor coupled in parallel between an input node and an output node, and being configured to input an input signal to the input node, and output an output signal to the output node; and a control circuit configured to control the transfer gate; and an auxiliary transfer gate including a P-type auxiliary transistor and an N-type auxiliary transistor coupled in parallel with the transfer gate between the input node and the output node, wherein the control circuit performs control to set, as a first value, a transistor size ratio that is a ratio of a size of the P-type transistor to a size of the N-type transistor when a voltage of the input signal is in a first voltage range at a timing at which the transfer gate is turned off, and set the transistor size ratio as a second value greater than the first value when a voltage of the input signal is in a second voltage range lower than that in the first voltage range at a timing at which the transfer gate is turned off, the control circuit performs control of turning the auxiliary transfer gate off from on after the transfer gate is turned off from on, and a total transistor size of the auxiliary transfer gate is smaller than a total transistor size of the transfer gate.

* * * * *